US008978751B2

(12) United States Patent
Castriotta et al.

(10) Patent No.: US 8,978,751 B2
(45) Date of Patent: Mar. 17, 2015

(54) METHOD AND APPARATUS FOR SEALING A WELLBORE

(75) Inventors: Sascha Antonio Castriotta, Houston, TX (US); Bradford Shane Franks, Alvin, TX (US)

(73) Assignee: National Oilwell Varco, L.P., Houston, TX (US)

( * ) Notice: Subject to any disclaimer, the term of this patent is extended or adjusted under 35 U.S.C. 154(b) by 516 days.

(21) Appl. No.: 13/400,098

(22) Filed: Feb. 19, 2012

(65) Prior Publication Data

US 2012/0227987 A1 Sep. 13, 2012

Related U.S. Application Data

(60) Provisional application No. 61/450,965, filed on Mar. 9, 2011.

(51) Int. Cl.
*E21B 33/06* (2006.01)

(52) U.S. Cl.
CPC ..... *E21B 33/062* (2013.01)
USPC ..... 166/85.4; 277/325; 251/1.1; 166/364

(58) Field of Classification Search
USPC ..... 166/85.4, 363, 364; 251/1.1, 1.2, 1.3; 277/325, 322, 324, 344
See application file for complete search history.

(56) References Cited

U.S. PATENT DOCUMENTS

| | | | |
|---|---|---|---|
| 2,035,925 | A | 3/1936 | Seamark |
| 2,178,698 | A | 11/1939 | Penick et al. |
| 2,193,110 | A | 3/1940 | Penick et al. |
| 2,194,256 | A | 3/1940 | Allen et al. |
| 2,231,613 | A | 2/1941 | Burke |
| 2,304,793 | A | 12/1942 | Bodine, Jr. |
| 2,592,197 | A | 4/1952 | Schweitzer |
| 2,609,836 | A | 9/1952 | Knox |
| 2,749,078 | A | 6/1956 | Losey |
| 2,752,119 | A | 6/1956 | Allen et al. |
| 3,001,803 | A | 9/1961 | Watts et al. |

(Continued)

FOREIGN PATENT DOCUMENTS

| | | |
|---|---|---|
| DE | 3516424 | 11/1986 |
| DE | 3317487 | 10/1993 |

(Continued)

OTHER PUBLICATIONS

International Search Report for PCT Application No. PCT/US2012/025767 dated Jun. 20, 2013, 3 pages.

(Continued)

*Primary Examiner* — Kenneth L Thompson
*Assistant Examiner* — Steven MacDonald
(74) *Attorney, Agent, or Firm* — JL Salazar Law Firm

(57) ABSTRACT

Methods and apparatuses for sealing a wellbore are provided. A seal assembly carried by a pair of opposing ram blocks of a blowout preventer is provided. The seal assembly includes a pair of seals carried by the pair of opposing ram blocks and a plurality of inserts carried by the pair of seals. The inserts include an upper body and a lower body with a rib therebetween. The upper and lower bodies each have an extended tip on a seal end thereof and a tip receptacle on a leading face thereof for receiving the extended tip. The extended tips are positionable in the tip receptacle of an adjacent inserts whereby an extrusion of a seal therebetween is restricted.

29 Claims, 17 Drawing Sheets

(56) References Cited

U.S. PATENT DOCUMENTS 3,028,917 A 4/1962 Rhodes
3,040,611 A 6/1962 Tournaire
3,242,826 A 3/1966 Smith
3,272,222 A 9/1966 Allen et al.
3,282,222 A 11/1966 Raufeisen et al.
3,399,728 A 9/1968 Taylor
3,434,729 A 3/1969 Shaffer et al.
3,554,278 A 1/1971 Reistle, III et al.
3,554,480 A 1/1971 Rowe
3,561,526 A 2/1971 Williams, Jr. et al.
3,572,628 A 3/1971 Jones
3,647,174 A 3/1972 LeRouax
3,670,761 A 6/1972 LeRouax
3,716,068 A 2/1973 Addison
3,741,296 A 6/1973 Murman et al.
3,744,749 A 7/1973 LeRouax
3,766,979 A 10/1973 Petrick
3,771,601 A 11/1973 Garrett
3,791,616 A 2/1974 Le Rouax
3,863,667 A 2/1975 Ward
3,871,613 A 3/1975 Le Rouax
3,897,038 A 7/1975 Le Rouax
3,897,071 A 7/1975 Le Rouax
3,915,424 A 10/1975 Le Rouax
3,915,426 A 10/1975 Le Rouax
3,917,293 A 11/1975 Lewis et al.
3,918,478 A 11/1975 Le Rouax
3,922,780 A 12/1975 Green
3,941,141 A 3/1976 Robert
3,946,806 A 3/1976 Meynier, III
3,955,622 A 5/1976 Jones
4,007,797 A 2/1977 Jeter
4,007,905 A 2/1977 Mott
4,043,389 A 8/1977 Cobb
4,052,995 A 10/1977 Ellison
4,057,887 A 11/1977 Jones et al.
4,076,208 A 2/1978 Olson
4,119,115 A 10/1978 Carruthers
4,132,265 A 1/1979 Williams, Jr.
4,132,266 A 1/1979 Randall
4,132,267 A 1/1979 Jones
4,140,041 A 2/1979 Frelau
4,162,057 A 7/1979 Qasim
4,188,860 A 2/1980 Miller
4,192,483 A 3/1980 Combes
4,215,749 A 8/1980 Dare et al.
4,220,206 A 9/1980 Van Winkle
4,229,012 A 10/1980 Williams, III
4,253,638 A 3/1981 Troxell, Jr.
4,265,424 A 5/1981 Jones
4,290,577 A 9/1981 Olson
4,305,565 A 12/1981 Abbe
4,313,496 A 2/1982 Childs et al.
4,323,256 A 4/1982 Miyagishima et al.
4,332,367 A 6/1982 Nelson
4,341,264 A 7/1982 Cox et al.
4,347,898 A 9/1982 Jones
4,372,527 A 2/1983 Rosenhauch et al.
4,392,633 A 7/1983 Van Winkle
4,416,441 A 11/1983 Van Winkle
4,437,643 A 3/1984 Brakhage, Jr. et al.
4,438,900 A 3/1984 Schaeper et al.
4,444,404 A * 4/1984 Parks, Jr. ..... 277/325
4,447,037 A 5/1984 Huey et al.
4,456,215 A 6/1984 Bishop et al.
4,458,876 A * 7/1984 Schaeper et al. ..... 251/1.2
4,492,359 A 1/1985 Baugh
4,502,534 A 3/1985 Roche et al.
4,504,037 A 3/1985 Beam et al.
4,508,311 A 4/1985 Just et al.
4,508,313 A 4/1985 Jones
4,516,598 A 5/1985 Stupak
4,518,144 A 5/1985 Vicic et al.
4,519,577 A 5/1985 Jones
4,523,639 A 6/1985 Howard, Jr.
4,526,339 A 7/1985 Miller
4,537,250 A 8/1985 Troxell, Jr.
4,540,045 A 9/1985 Molitor
4,540,046 A 9/1985 Granger
4,550,895 A 11/1985 Shaffer
4,558,842 A 12/1985 Pell et al.
4,568,842 A 2/1986 Koike
4,582,293 A 4/1986 Jones
4,601,232 A 7/1986 Troxell, Jr.
4,612,983 A 9/1986 Karr, Jr.
4,646,825 A 3/1987 Van Winkle
4,647,002 A 3/1987 Crutchfield
4,655,284 A 4/1987 McIlvride
4,690,033 A 9/1987 Van Winkle
4,690,411 A 9/1987 Van Winkle
4,699,350 A 10/1987 Herve
4,770,387 A 9/1988 Granger
4,840,346 A 6/1989 Adnyana et al.
4,877,217 A 10/1989 Peil et al.
4,911,410 A 3/1990 Baker
4,922,423 A 5/1990 Komey et al.
4,923,005 A 5/1990 Laky et al.
4,923,006 A 5/1990 Hartmann et al.
4,923,008 A 5/1990 Wachowicz et al.
4,930,745 A 6/1990 Granger et al.
4,938,290 A 7/1990 Leggett et al.
4,943,031 A 7/1990 Van Winkle
4,969,390 A 11/1990 Williams, III
4,969,627 A 11/1990 Williams, III
4,997,162 A 3/1991 Baker et al.
5,002,130 A 3/1991 Laky
5,005,802 A 4/1991 McWhorter et al.
5,011,110 A 4/1991 Le
5,013,005 A 5/1991 Nance
5,025,708 A 6/1991 Smith et al.
5,056,418 A 10/1991 Granger et al.
5,063,828 A 11/1991 Kamimura
5,064,164 A 11/1991 Le
5,125,620 A 6/1992 Young
5,150,049 A 9/1992 Schuetz
5,178,215 A 1/1993 Yenulis et al.
5,199,493 A 4/1993 Sodder, Jr.
5,199,683 A 4/1993 Le
5,217,073 A 6/1993 Bruns
5,237,899 A 8/1993 Schartinger
5,255,890 A 10/1993 Morrill
5,294,088 A 3/1994 McWhorter et al.
5,320,325 A 6/1994 Young et al.
5,360,061 A 11/1994 Womble
5,361,832 A 11/1994 Van Winkle
5,400,857 A 3/1995 Whitby et al.
5,407,172 A 4/1995 Young et al.
5,501,424 A 3/1996 Williams et al.
5,505,426 A 4/1996 Whitby et al.
5,515,916 A 5/1996 Haley
5,566,753 A 10/1996 Van Winkle et al.
5,575,451 A 11/1996 Colvin et al.
5,575,452 A 11/1996 Whitby et al.
5,588,491 A 12/1996 Brugman et al.
5,590,867 A 1/1997 Van Winkle
5,653,418 A 8/1997 Olson
5,655,745 A 8/1997 Morrill
5,662,171 A 9/1997 Brugman et al.
5,713,581 A 2/1998 Carlson et al.
5,735,502 A 4/1998 Levett et al.
5,775,420 A 7/1998 Mitchell et al.
5,778,918 A 7/1998 McLelland
5,833,208 A 11/1998 Lee, Jr.
5,863,022 A 1/1999 Van Winkle
5,897,074 A 4/1999 Marino
5,897,094 A 4/1999 Brugman et al.
5,918,851 A 7/1999 Whitby
5,944,110 A 8/1999 Watts et al.
5,961,094 A 10/1999 Van Winkle
5,975,484 A 11/1999 Brugman et al.
6,006,647 A 12/1999 Van Winkle
6,012,528 A 1/2000 Van Winkle
6,016,880 A 1/2000 Hall et al.
D425,525 S 5/2000 Wooten

(56) References Cited

U.S. PATENT DOCUMENTS

| | | | |
|---|---|---|---|
| 6,089,526 | A | 7/2000 | Olson |
| 6,113,061 | A | 9/2000 | Van Winkle |
| 6,158,505 | A | 12/2000 | Araujo |
| 6,164,619 | A | 12/2000 | Van Winkle et al. |
| 6,173,770 | B1 | 1/2001 | Morrill |
| 6,192,680 | B1 | 2/2001 | Brugman et al. |
| 6,244,336 | B1 | 6/2001 | Kachich |
| 6,244,560 | B1 | 6/2001 | Johnson |
| 6,276,450 | B1 | 8/2001 | Seneviratne |
| 6,296,225 | B1 | 10/2001 | Watts |
| 6,367,804 | B1 | 4/2002 | Watts |
| 6,374,925 | B1 | 4/2002 | Elkins et al. |
| 6,454,015 | B1 | 9/2002 | Armstrong et al. |
| 6,484,808 | B2 | 11/2002 | Jones et al. |
| 6,509,733 | B2 | 1/2003 | Blubaugh et al. |
| 6,510,895 | B1 | 1/2003 | Koleilat et al. |
| 6,510,897 | B2 | 1/2003 | Hemphill |
| 6,530,432 | B2 | 3/2003 | Gipson |
| 6,554,247 | B2 | 4/2003 | Berckenhoff et al. |
| 6,601,650 | B2 | 8/2003 | Sundararajan |
| 6,718,860 | B2 | 4/2004 | Mitsukawa et al. |
| 6,719,042 | B2 | 4/2004 | Johnson et al. |
| 6,742,597 | B2 | 6/2004 | Van Winkle et al. |
| 6,782,799 | B2 | 8/2004 | Vincent |
| 6,834,721 | B2 | 12/2004 | Suro |
| 6,843,463 | B1 | 1/2005 | McWhorter et al. |
| 6,845,959 | B2 | 1/2005 | Berckenhoff et al. |
| 6,857,634 | B2 | 2/2005 | Araujo |
| 6,877,712 | B2 | 4/2005 | Wiedemann |
| 6,955,357 | B2 | 10/2005 | Griffin et al. |
| 6,964,303 | B2 | 11/2005 | Mazorow et al. |
| 6,969,042 | B2 | 11/2005 | Gaydos |
| 6,974,135 | B2 | 12/2005 | Melancon et al. |
| 7,004,444 | B2 | 2/2006 | Kinder |
| 7,011,159 | B2 | 3/2006 | Holland |
| 7,011,160 | B2 | 3/2006 | Boyd |
| 7,023,199 | B2 | 4/2006 | Blubaugh et al. |
| 7,036,613 | B2 | 5/2006 | Burr |
| 7,044,430 | B2 | 5/2006 | Brugman et al. |
| 7,051,989 | B2 | 5/2006 | Springett et al. |
| 7,051,990 | B2 | 5/2006 | Springett et al. |
| 7,055,594 | B1 | 6/2006 | Springett et al. |
| 7,086,467 | B2 | 8/2006 | Schlegelmilch et al. |
| 7,100,892 | B2 | 9/2006 | Iwabuchi |
| 7,108,081 | B2 | 9/2006 | Boyadjieff |
| 7,121,185 | B2 | 10/2006 | Alrefai |
| 7,125,055 | B2 | 10/2006 | Dallas |
| 7,159,652 | B2 | 1/2007 | McGuire et al. |
| 7,165,619 | B2 | 1/2007 | Fox et al. |
| 7,181,808 | B1 | 2/2007 | Van Winkle |
| 7,195,224 | B2 | 3/2007 | Le |
| 7,207,382 | B2 | 4/2007 | Schaeper |
| 7,216,872 | B1 | 5/2007 | Shaw et al. |
| 7,225,793 | B2 | 6/2007 | Schwulst et al. |
| 7,225,873 | B2 | 6/2007 | Schlegelmilch et al. |
| 7,234,530 | B2 | 6/2007 | Gass |
| 7,243,713 | B2 | 7/2007 | Isaacks et al. |
| 7,246,666 | B2 | 7/2007 | Hemphill et al. |
| 7,270,190 | B2 | 9/2007 | McWhorter et al. |
| 7,274,989 | B2 | 9/2007 | Hopper |
| 7,287,544 | B2 | 10/2007 | Seneviratne et al. |
| 7,300,642 | B1 | 11/2007 | Pedersen et al. |
| 7,331,562 | B2 | 2/2008 | Springett |
| 7,350,587 | B2 | 4/2008 | Springett et al. |
| 7,354,026 | B2 | 4/2008 | Urrutia |
| 7,360,603 | B2 | 4/2008 | Springett et al. |
| 7,367,396 | B2 | 5/2008 | Springett et al. |
| 7,389,817 | B2 | 6/2008 | Almdahl et al. |
| 7,410,003 | B2 | 8/2008 | Ravensbergen et al. |
| 7,434,369 | B2 | 10/2008 | Uneyama et al. |
| 7,464,751 | B1 | 12/2008 | Abel |
| 7,464,765 | B2 | 12/2008 | Isaacks et al. |
| 7,487,848 | B2 | 2/2009 | Wells et al. |
| 7,510,002 | B2 | 3/2009 | Brown et al. |
| 7,520,129 | B2 | 4/2009 | Springett |
| 7,523,644 | B2 | 4/2009 | Van Winkle |
| 7,611,120 | B2 * | 11/2009 | Wood ..... 251/1.3 |
| 7,673,674 | B2 | 3/2010 | Lam |
| 7,703,739 | B2 | 4/2010 | Judge et al. |
| 7,721,808 | B2 | 5/2010 | Dallas et al. |
| 7,726,418 | B2 | 6/2010 | Ayling |
| 7,748,473 | B2 | 7/2010 | Wells et al. |
| 7,798,466 | B2 | 9/2010 | Springett et al. |
| 7,814,979 | B2 | 10/2010 | Springett et al. |
| 7,832,706 | B2 | 11/2010 | Judge |
| 7,926,501 | B2 | 4/2011 | Springett |
| 7,967,299 | B2 | 6/2011 | McClanahan |
| 8,033,338 | B2 | 10/2011 | Springett |
| 8,066,070 | B2 | 11/2011 | Springett |
| 2004/0021269 | A1 | 2/2004 | Gaudette |
| 2004/0124380 | A1 | 7/2004 | Van Winkle |
| 2005/0242519 | A1 | 11/2005 | Koleilat |
| 2006/0076526 | A1 | 4/2006 | McWhorter |
| 2006/0144586 | A1 | 7/2006 | Urrutia |
| 2006/0228284 | A1 | 10/2006 | Schmidt |
| 2006/0278406 | A1 | 12/2006 | Judge et al. |
| 2007/0075288 | A1 | 4/2007 | Matte |
| 2007/0137688 | A1 | 6/2007 | Yoshida |
| 2007/0236006 | A1 | 10/2007 | Fultz |
| 2008/0040070 | A1 | 2/2008 | McClanahan |
| 2008/0076526 | A1 | 3/2008 | Zhang |
| 2008/0115478 | A1 | 5/2008 | Sullivan |
| 2008/0135791 | A1 | 6/2008 | Juda |
| 2008/0185046 | A1 | 8/2008 | Springett et al. |
| 2008/0189954 | A1 | 8/2008 | Lin |
| 2008/0196888 | A1 | 8/2008 | Judge et al. |
| 2008/0267786 | A1 | 10/2008 | Springett |
| 2009/0056132 | A1 | 3/2009 | Foote |
| 2010/0038088 | A1 | 2/2010 | Springett |
| 2010/0243926 | A1 | 9/2010 | Weir |
| 2010/0319906 | A1 | 12/2010 | Van Winkle |
| 2012/0012340 | A1 | 1/2012 | Ensley et al. |

FOREIGN PATENT DOCUMENTS

| | | |
|---|---|---|
| EP | 0916385 | 5/1999 |
| GB | 1352258 | 9/1971 |
| GB | 1352260 | 9/1971 |
| GB | 2154265 | 3/1985 |
| WO | 2009025835 | 2/2009 |

OTHER PUBLICATIONS

International Report on Patentability and Written Opinion for PCT Application No. PCT/US2012/025767 dated Sep. 10, 2013, 6 pages.

English translation of Abstract for German Patent Application No. 3516424, retrieved from the Internet on Feb. 1, 2012, [website address: http://depatisnet.dpma.de/DepatisNet/depatisnet?window=1&space=main&content=treffer&action=textpdf&docid=DE000003516424A1], 3 pages.

English translation of Abstract for German Patent Application No. 3317487, retrieved from the internet on Feb. 3, 2012, [website address: http://depatisnet.dpma.de/DepatisNet/depatisnet?window=1&space=main&content=treffer&action=textpdf&docid=DE000003317487A1], 3 pages.

National Oilwell Varco. Shaffer 7"—5,000 PSI LXT RAM BOP Datasheet [online], [retrieved on Jan. 10, 2012]. Retrieved from the Internet: <URL: http://apps.nov.com/GetDocument/getDocument.aspx?doc=VauwU3oEmlRR5tXu4pHU9ZMorUn8t2fOkk/epJTd2wnzTwxUs9rJPGQhaetY9s5p0pUJ7Mjkr4e0TprFOSNmF9cRCTKggbZab8rkFiiVJxrGzB5CkviJajOOYKt8UeNI>.

National Oilwell Varco. Shaffer 9"—3,000 PSI LXT RAM BOP Datasheet [online], [retrieved on Jan. 10, 2012]. Retrieved from the Internet: <URL: http://apps.nov.com/GetDocument/getDocument.aspx?doc=4mY2KOczvSp7xgbC/yAUNOlj8Xip0PFoCBfMqXeGZv8yoA+gy0YSN67XJhL9yJC7Jxv0KFBqycdmv+celNv8DKr9O1KrswSLTodwdeUHOjfSYNNAb8w4/Q3y6GJsnuyAdWmpT+6mzpjzD1T5hCdNCxLvXPFLH2z0Jp41vjuaVZw=>.

(56) References Cited

OTHER PUBLICATIONS

National Oilwell Varco. Shaffer 11"—5,000 PSI LXT RAM BOP Datasheet [online], [retrieved on Jan. 10, 2012]. Retrieved from the Internet: <URL: http://apps.nov.com/GetDocument/getDocument.aspx?doc=4mY2KOczySp7xgbC/yAUNHH4NngVNvgjSTgsbDKUG2SvCR7H5ZESdyAEqrxcgW/o6rqufYWXU6DWKF7jlGbLunTH4s52FHRihfqSujUiMirakeTXNCByEVNU0oIPTHu8FOg3BT3zRZDOEdgl76cV9g==>.
National Oilwell Varco. Shaffer 13 5/8"—10,000 PSI LXT RAM BOP Datasheet [online], [retrieved on Jan. 10, 2012]. Retrieved from the Internet: <URL: http://apps.nov.com/GetDocument/getDocument.aspx.doc=4mY2KOczySp7xgbC/yAUNEwbgkvE1aylKwH+U89zJRfdujD68A7tvPw4eyAA3lz4dH2ZExbPe0QnqqPI5q3SS33II6fKz+jwj9AVe2+jHPmG+9ahyvcejLFqDBkZfKmtrkaeiTCdGx+7e1+EE3ukehmBileYewHbwgkhaYTbBOk=>.
National Oilwell Varco. LWS Shaffer Ram Blowout Preventer [online], [retrieved on Jan. 10, 2012]. Retrieved from the Internet: <URL: http://www.nov.com/Drilling/Drilling_Pressure_Control/Blowout_Preventers/Ram_BOPs/LWS_Shaffer_Ram_Blowout_Preventer.aspx>.
National Oilwell Varco. NXT—Ram Blowout Preventer [online], [retrieved on Jan. 10, 2012]. Retrieved from the Internet: <URL: http://www.nov.com/Drilling/Drilling_Pressure_Control/Blowout_Preventers/Ram_BOPs/NXT-RAM_Blowout_Preventer.aspx>.
National Oilwell Varco. Ram Blowout Preventers [online], [retrieved on Jan. 10, 2012]. Retrieved from the Internet: <URL: http://www.nov.com/Drilling/Drilling_Pressure_Control/Blowout_Preventers/Ram_BOPs.aspx>.
National Oilwell Varco. Shaffer—SLX Ram Blowout Preventer [online], [retrieved on Jan. 10, 2012]. Retrieved from the Internet: <URL: http://www.nov.com/Drilling/Drilling_Pressure_Control/Blowout_Preventers/Ram_BOPs/Shaffer-SLX_Ram_Blowout_Preventer.aspx>.
Varco's NXT® Next Generation BOP Systems reduce the cost of drilling (6 pages) (2011).
The Cameron Variable Bore Ram, Cameron Oil Tools (9 pages) (1978).
Ram-Type Blowout Preventers Rams, NL Shaffer, pp. 32-33 (Jan. 1979).
UltraLock II Automatic Locking System, Shaffer® A Varco Company (2 pages) (2002).
Examination Report for Canadian Patent Application No. 2,828,956 dated Sep. 23, 2014, 2 pages.
Examination Report for Korean Patent Application No. 10-2013-7023427 dated Sep. 16, 2014, 12 pages.

* cited by examiner

METHOD AND APPARATUS FOR SEALING A WELLBORE

CROSS-REFERENCE TO RELATED APPLICATIONS

This patent application claims priority to U.S. provisional patent application Ser. No. 61/450,965 filed on Mar. 9, 2011 and entitled "METHOD AND APPARATUS FOR SEALING A WELLBORE."

BACKGROUND

The present disclosure relates generally to oilfield operations. More specifically, the present disclosure relates to techniques for sealing a wellbore.

Oilfield operations are typically performed to locate and gather valuable downhole fluids. Oil rigs are positioned at wellsites and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Tubing or pipes are typically positioned in the wellbore to enable the passage of subsurface fluids to the surface.

Leakage of subsurface fluids may pose a significant environmental threat if released from the wellbore. Equipment, such as blow out preventers (BOPs), are often positioned about the wellbore to form a seal about pipes and to prevent leakage of fluid as it is brought to the surface. BOPs may employ rams and/or ram blocks that seal the wellbore. Some examples of ram BOPs and/or ram blocks are provided in U.S. Pat. Nos. 4,647,002, 6,173,770, 5,025,708, 7,051,989, 5,575,452, 6,374,925, 20080265188, U.S. Pat. No. 5,735, 502, U.S. Pat. No. 5,897,094, U.S. Pat. No. 7,234,530 and 2009/0056132. The BOPs may be provided with various devices to seal various portions of the BOP as described, for example, in U.S. Pat. Nos. 4,508,311, 5,975,484, 6,857,634 and 6,955,357. Despite the development of sealing techniques, there remains a need to provide advanced techniques for sealing wellbores.

SUMMARY

The present disclosure relates to techniques for sealing a pipe of a wellbore. Inserts may be positioned in a seal assembly of carried by a pair of opposing ram blocks of a blowout preventer. The inserts have upper and lower bodies with a rib therebetween. The upper and lower bodies are provided with extended tips on a seal end thereof and tip receptacles on a leading face thereof. The extended tips are receivable in the tip receptacles of an adjacent insert to restrict extrusion of therebetween. The upper and lower bodies may also be provided with recesses and ledges for interlocking engagement and slidable movement between the inserts. Scallops may be provided along the tips to conform to various pipe diameters.

In another aspect, the disclosure relates to a seal assembly of a blowout preventer. The blowout preventer includes a pair of opposing ram blocks positionable about a pipe of a wellsite. The seal assembly includes a pair of seals carried by the pair of opposing ram blocks and a plurality of inserts. The inserts carried by the pair of seals and positionable about the pipe in an elliptical array. Each of the inserts having an upper body and a lower body with a rib therebetween. Each of the upper and lower bodies have an extended tip on a seal end thereof and a tip receptacle on a leading face thereof. The extended tips of the upper and lower bodies of each of the inserts are receivable in the tip receptacles of an adjacent one of the inserts whereby extrusion of the pair of seals between the inserts is restricted.

In yet another aspect, the disclosure relates to a blowout preventer for sealing a pipe of a wellsite. The blowout preventer includes a housing, a pair of opposing ram blocks positionable about a pipe of a wellsite, and a seal assembly. The seal assembly includes a pair of seals carried by the pair of opposing ram blocks and positionable in sealing engagement about the pipe and a plurality of inserts. The inserts are carried by the pair of seals and positionable about the pipe in an elliptical array. Each of the inserts have an upper body and a lower body with a rib therebetween. Each of the upper and lower bodies have an extended tip on a seal end thereof and a tip receptacle on a leading face thereof. The extended tips of the upper and lower bodies of each of the inserts are receivable in the tip receptacles of an adjacent one of the inserts whereby extrusion of the pair of seals between the inserts is restricted.

Finally, in yet another aspect, the disclosure relates to a method of sealing a pipe of a wellsite. The method involves providing a blowout preventer including a housing, a pair of opposing ram blocks positionable about the pipe, and a seal assembly. The seal assembly includes a pair of seals carried by the opposing ram blocks and a plurality of inserts. The carried by the seals. The inserts have an upper body and a lower body with a rib therebetween. Each of the upper and lower bodies has an extended tip on a seal end thereof and a tip receptacle on a leading face thereof. The method further involves positioning the inserts of the seal assembly about the pipe in an elliptical array by advancing the opposing ram blocks toward the pipe, and restricting extrusion of the pair of seals between the inserts by receiving the extended tips of the upper and lower bodies of each of the inserts in the tip receptacles of an adjacent one of the inserts.

BRIEF DESCRIPTION OF THE DRAWINGS

So that the above recited features and advantages of the present disclosure can be understood in detail, a more particular description of the technology herein, briefly summarized above, may be had by reference to the embodiments thereof that are illustrated in the appended drawings. It is to be noted, however, that the appended drawings illustrate only typical embodiments of this technology and are, therefore, not to be considered limiting of its scope, for the disclosure may admit to other equally effective embodiments. The figures are not necessarily to scale, and certain features and certain views of the figures may be shown exaggerated in scale or in schematic in the interest of clarity and conciseness.

DETAILED DESCRIPTION

The description that follows includes exemplary apparatuses, methods, techniques, and instruction sequences that embody techniques of the present subject matter. However, it is understood that the described embodiments may be practiced without these specific details.

The disclosure relates to techniques for sealing a wellbore. The techniques involve inserts used, for example, in a ram block of a blowout preventer. The inserts may be positioned about a tubular (or pipe) for forming a seal therewith. It may be desirable to provide techniques that more effectively seal, even under high pressure conditions. It may be further desirable to provide techniques that more effectively seal about a variety of pipe diameters. Preferably, such techniques involve one or more of the following, among others: ease of operation, simple design, adaptability to a variety of applications, reduced failures, performance under harsh conditions, conformance to equipment shapes and/or sizes, increased capacity, etc. The present disclosure is directed to fulfilling these needs in the art.

Figure 1:
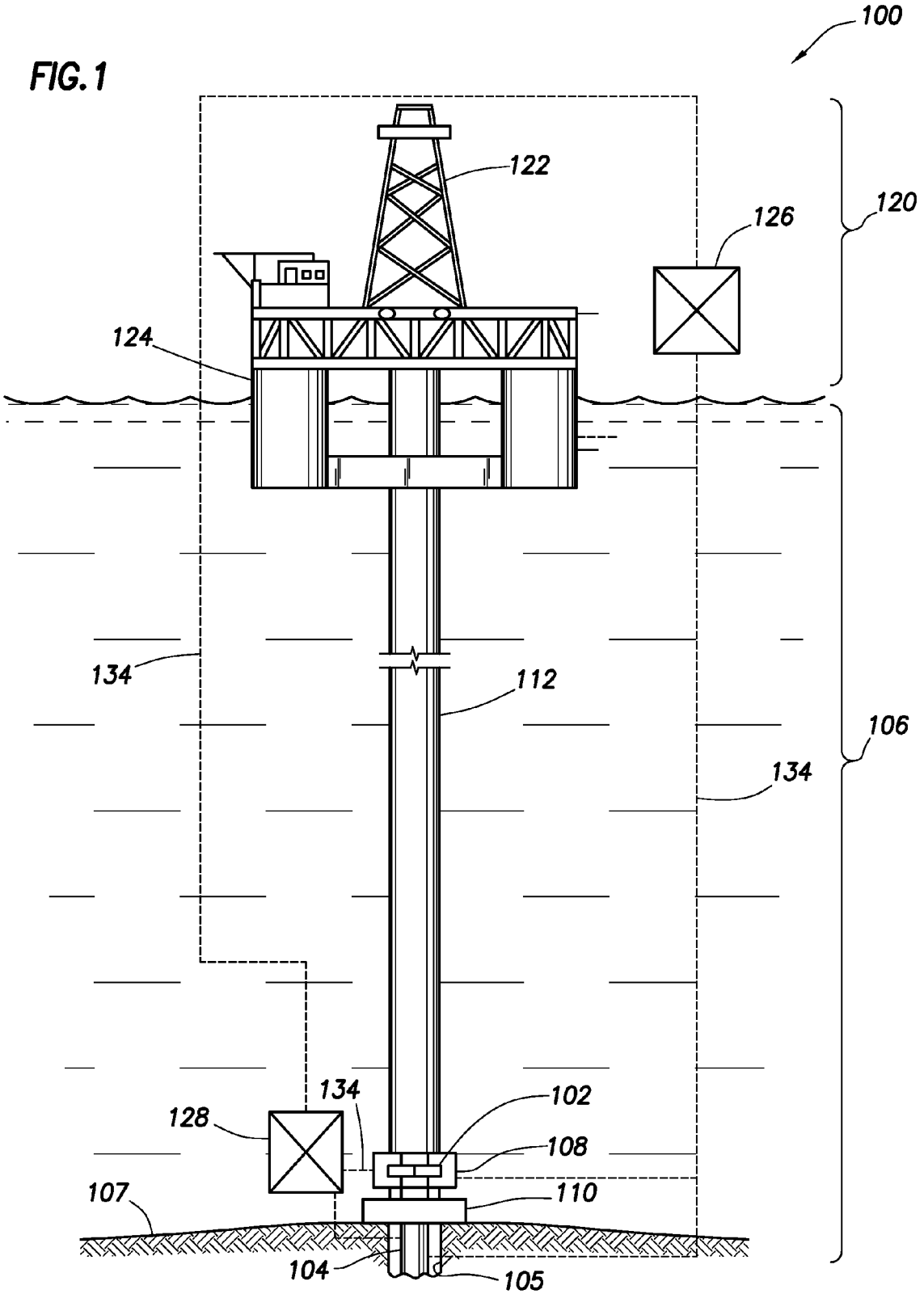
FIG. 1 is a schematic view of an offshore wellsite having a BOP with a seal assembly therein according to the disclosure.

FIG. 1 depicts an offshore wellsite 100 having a blowout preventer (BOP) 108 configured to seal a wellbore 105 extending into a seabed 107. The BOP 108 has a seal assembly 102 positioned therein. As shown, the BOP 108 is part of a subsea system 106 positioned on the seabed 107. The subsea system 106 may also comprise a pipe (or tubular) 104 extending through the wellbore 105, a wellhead 110 about the wellbore 105, a conduit 112 extending from the wellbore 105, and other subsea devices, such as a stripper and a conveyance delivery system (not shown). While the wellsite 100 is depicted as a subsea operation, it will be appreciated that the wellsite 100 may be land or water based.

A surface system 120 may be used to facilitate operations at the offshore wellsite 100. The surface system 120 may comprise a rig 122, a platform 124 (or vessel) and a surface controller 126. Further, there may be one or more subsea controllers 128. While the surface controller 126 is shown as part of the surface system 120 at a surface location and the subsea controller 128 is shown part of the subsea system 106 in a subsea location, it will be appreciated that one or more controllers may be located at various locations to control the surface and/or subsea systems.

To operate the BOP 108 and/or other devices associated with the wellsite 100, the surface controller 126 and/or the subsea controller 128 may be placed in communication. The surface controller 126, the subsea controller 128, and/or any devices at the wellsite 100 may communicate via one or more communication links 134. The communication links 134 may be any suitable communication means, such as hydraulic lines, pneumatic lines, wiring, fiber optics, telemetry, acoustics, wireless communication, any combination thereof, and the like. The BOP 108 and/or other devices at the wellsite 100 may be automatically, manually and/or selectively operated via the controllers 126 and/or 128.

Figure 2:
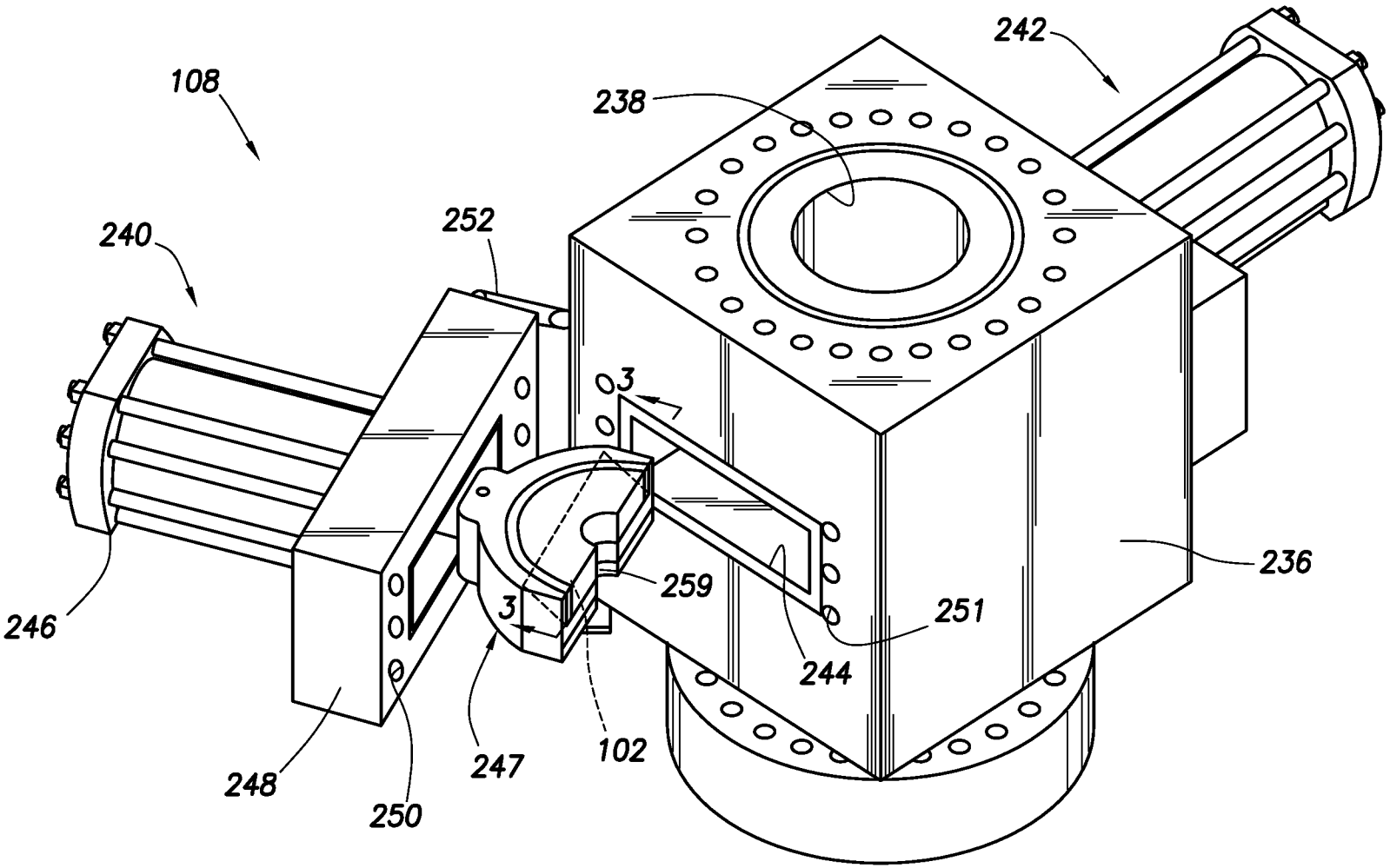
FIG. 2 is a schematic view of the BOP of FIG. 1 having ram blocks with the seal assembly thereon.

FIG. 2 shows a detailed, schematic view of a BOP 108 that may be used as the BOP 108 of FIG. 1. The BOP 108 may be a conventional BOP having a body 236 with a central passageway 238 therethrough for receiving a pipe (e.g., 104 of FIG. 1). The BOP 108 also includes a pair of conventional ram assemblies 240, 242 on opposite sides thereof. Examples of BOPs, ram assemblies and/or ram blocks usable with the BOP 108 are described in U.S. Pat. No. 5,735,502, the entire contents of which is hereby incorporated by reference. The ram assembly 240 has been pivotally retracted to reveal ram block 247. The seal assembly 102 is positionable within each of the ram blocks 247 for providing a seal with a pipe positioned in the central passageway 238.

Each ram assembly 240, 242 is in communication with a respective one of the radially opposing chambers 244 in the BOP body that extend radially outward from the central passageway 238. Each ram assembly 240, 242 may include a ram body 246, the ram block 247 and a ram door 248. Ram door 248 may be secured to the BOP body 236 by conventional bolts (not shown) which pass through respective apertures 250 in the ram door 248 and thread to corresponding ports 251 in the BOP body 236.

The ram assemblies 240, 242 may be pivotally mounted on the BOP body 236 by pivot arms 252, thereby facilitating repair and maintenance of the ram blocks 247. Bolts in the passageway 250 may thus be unthreaded from the BOP body 236, and the ram assembly 240 swung open, as shown in FIG. 2, to expose the ram block 247.

The ram blocks 247 have an arcuate shaped body with an arcuate shaped inlet 259 configured to receive a portion of the pipe 104 for sealing engagement therewith. Once in position, the ram block 247 may be selectively activated to move within the seal assembly 102 to a sealed position about the pipe 104 positioned therein.

Figure 3B:
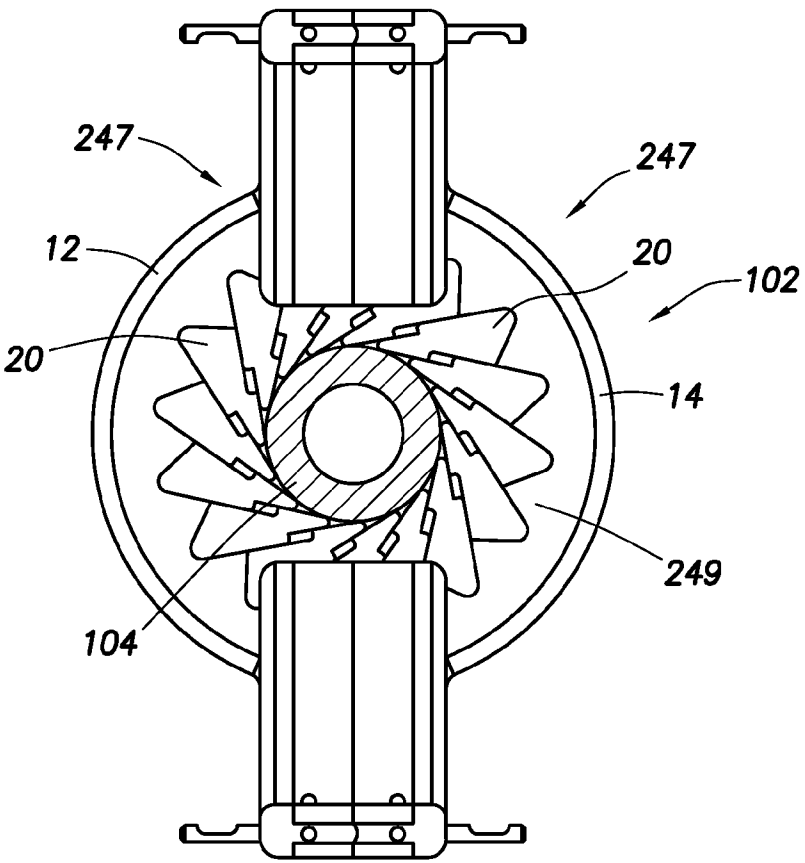
FIGS. 3A and 3B are schematic views of ram blocks with a seal assembly thereon in a retracted and sealed position, respectively.
Figure 3A:
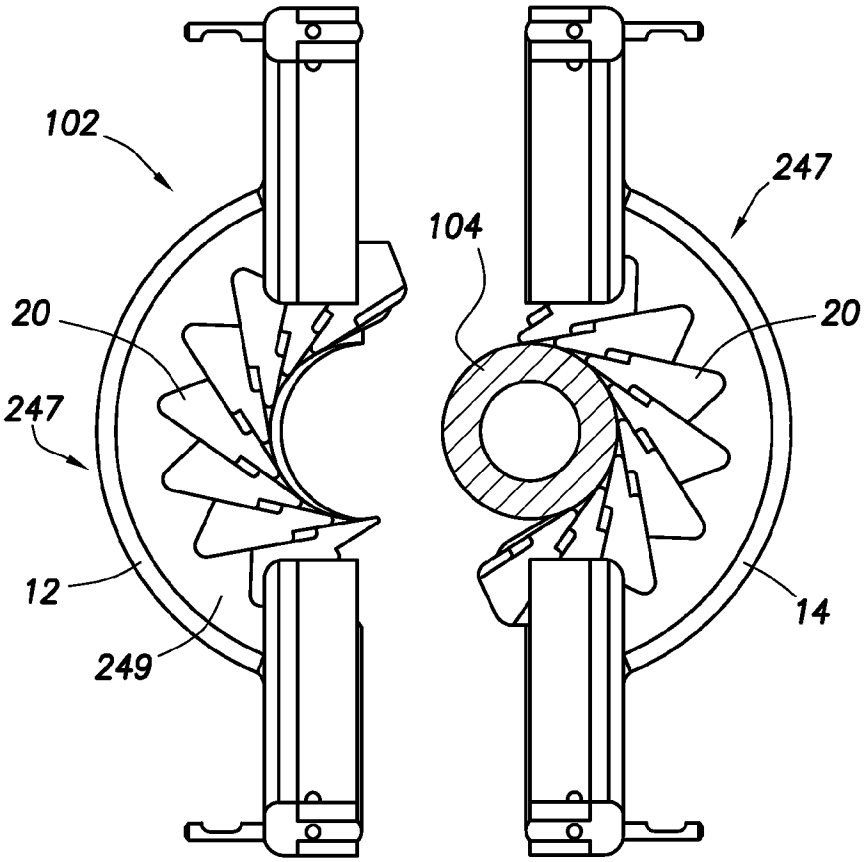

FIGS. 3A-3B show a portion of conventional ram blocks assemblies 12, 14 in various positions about the pipe 104. The ram block assemblies 12, 14 may be used as part of the ram blocks 247 of FIG. 2. The ram blocks 247 are provided with a seal assembly 102 thereon for supporting a rubber gland (or seal) 249. The seal assembly 102 may be configured to seal on multiple pipe diameters. During activation of the ram blocks 247, the rubber gland 249 is advanced toward the drill pipe 104 and forced under hydraulic pressure to conform to the drill pipe 104. To protect the rubber gland 249 (and potentially extend its life), the rubber gland 249 may be molded with inserts (or metal reinforcements) 20 that aid in retaining the gland 249 and/or prevent rubber extrusion.

As shown in FIG. 3B, the inserts 20 are positionable in an elliptical, iris configuration, sometimes referred to as an insert array. The movement of the inserts 20 is similar to the iris of an eye that alters the inner diameter of the pupil (or hole) receiving the pipe 104. The inserts 20 are slidingly moveable between a refracted (or unsealed) and a sealed position, and interlocked for cooperative movement therebetween. The inserts 20 are designed to support the rubber gland 249 to enhance a seal formed by the rubber gland 249 about the pipe 104 during operation.

Figure 4A:
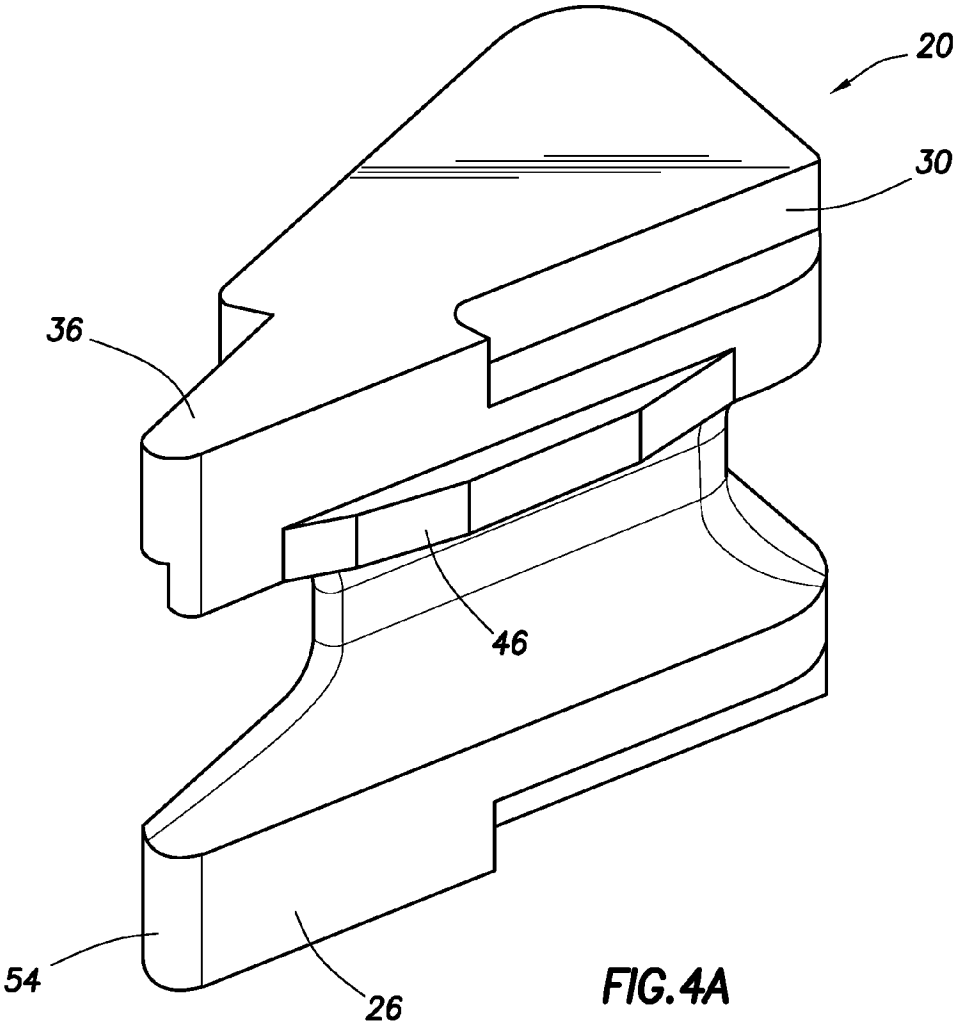
FIGS. 4A-4C are various schematic views of an insert of a seal assembly.
Figure 4C:
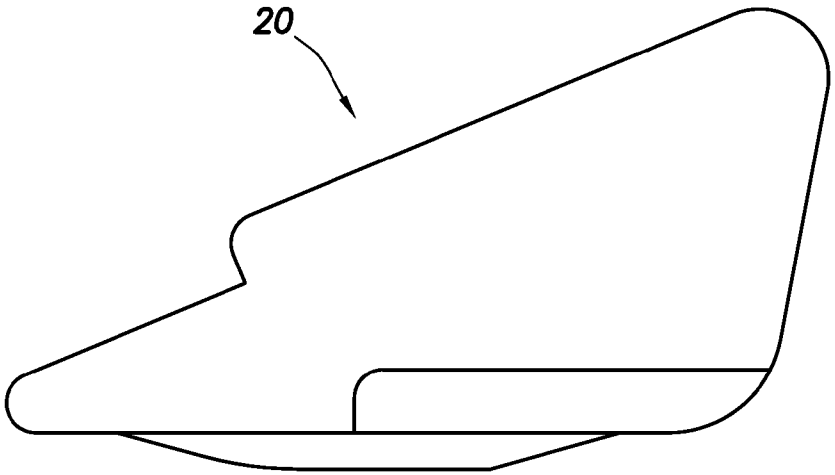
Figure 4B:
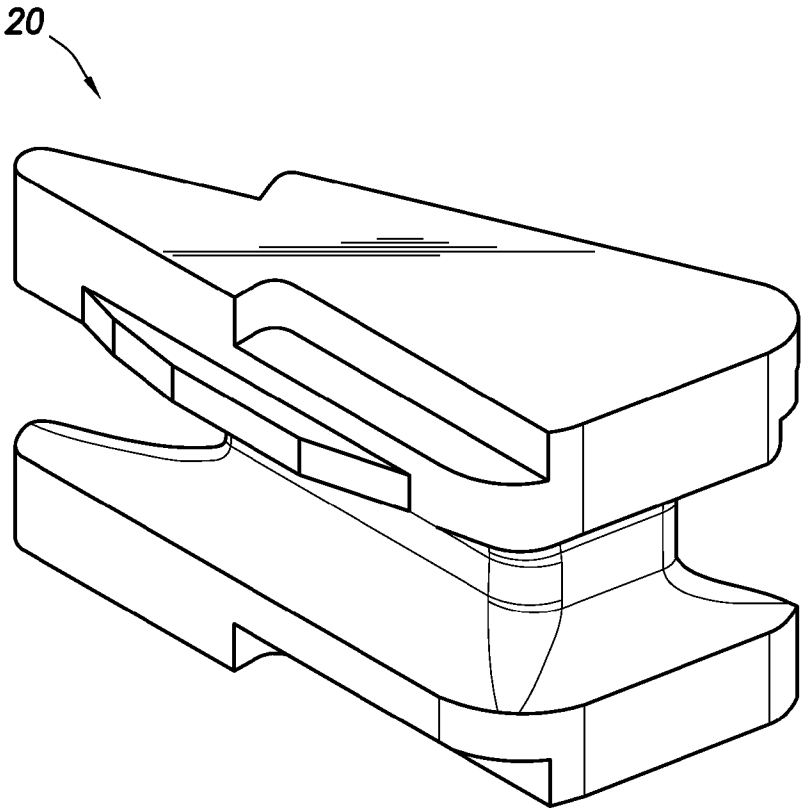

Conventional inserts 20 are detailed in FIGS. 4A-4C. These inserts 20 are described in further detail in U.S. Pat. No. 6,857,634, the entire contents of which is hereby incorporated by reference. The inserts 20 have an upper body 24 and a lower body 26. Each of the upper and lower bodies 24, 26 are provided with a ledge 30 and a corresponding recess 36 and an anti-extrusion ledge 46 thereon.

Figure 5A:
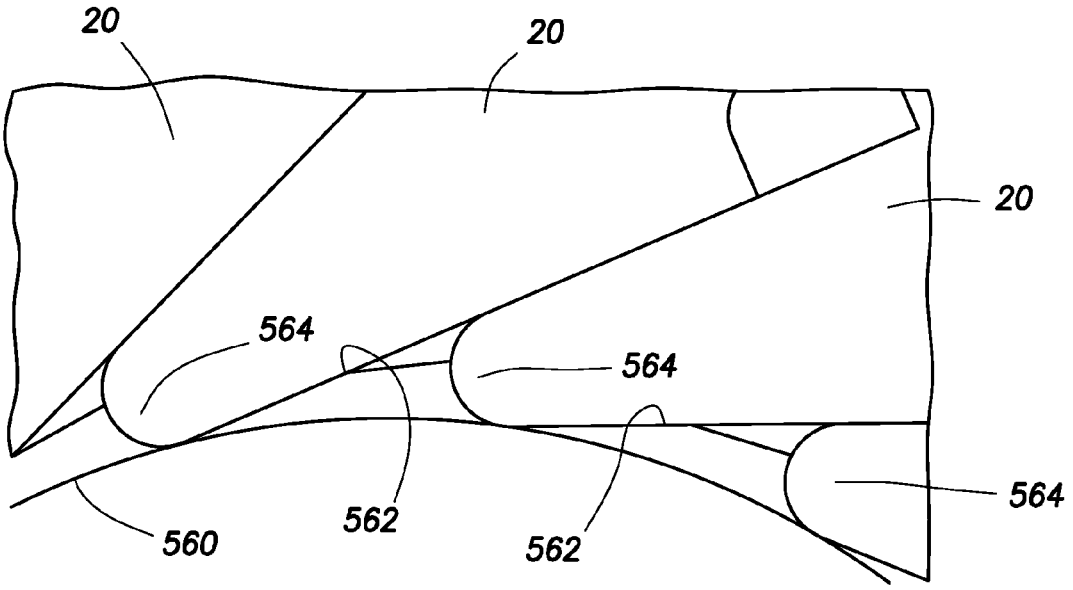
FIGS. 5A and 5B are schematic views of a portion of a seal assembly having a gap and a reduced gap, respectively.

To enhance the operation of the seal assembly 102, the inserts 20 may optionally be provided with geometries that provide support to the seal assembly 102 and/or reduce extrusion of the rubber gland 249 about the pipe 104 during operation of the ram blocks 247. FIG. 5A shows a portion of the array of inserts 20 of FIG. 3B. As shown in FIG. 5A, conventional inserts 20 define an inner diameter 560 for receiving pipe 104 (FIG. 1). The inserts 20 have tips 564 at an end adjacent the inner diameter 560, and may define gaps 562 between the inserts 20 along the inner diameter 560. These large gaps provide space between the inserts and the drill pipe that define an extrusion path or gap for the rubber gland 249. In some cases, extrusion gaps of up to 0.125 inches (0.32 cm) may be present.

Figure 5B:
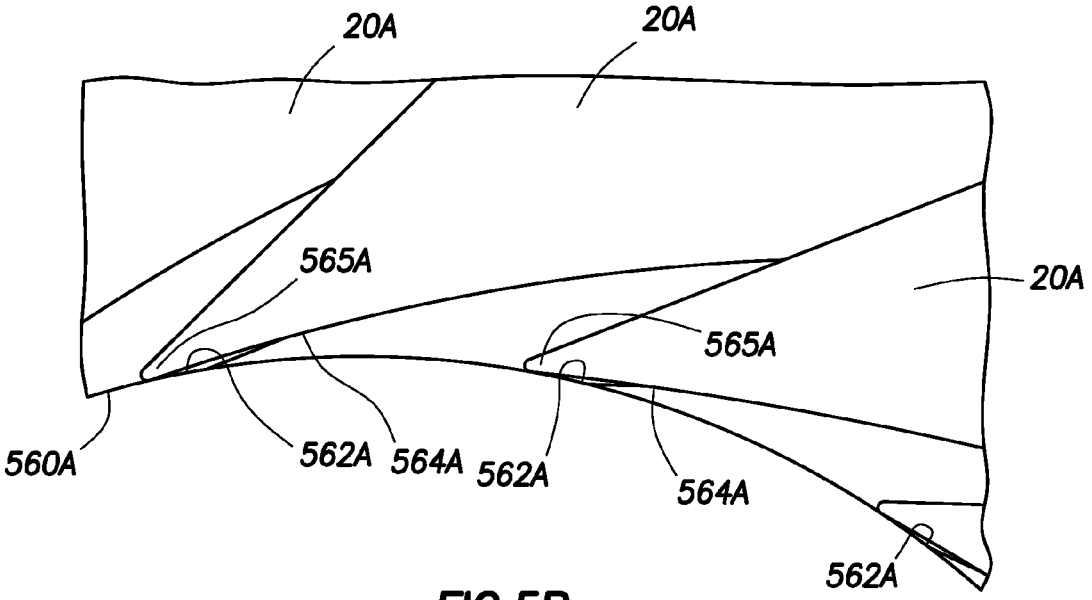

To reduce or restrict the extrusion between the inserts, it may be desirable to reduce the gaps 562. These reduced gaps may reduce the open area (or space) between the pipe 104 and the inserts 20 to restrict extrusion therethrough. As shown in FIG. 5B, alternate inserts 20*a* are provided with extended tips 564*a* that extend beyond a secondary tip 565*a* on a seal end of the insert 20*a*. The extended tips 564*a* may be used to provide a reduced gap 562*a* therebetween along inner diameter 560*a*. The geometry of the inserts 20*a* may be used to minimize the extrusion gap 562*a* by providing geometry that incrementally matches various pipe sizes. The shape, size and quantity of the geometries may vary based on a desired range of coverage and/or operating conditions.

The inserts may be provided with various features, such as scallops (or facets) as will be described further herein, to reduce this gap to, for example, about 0.015-0.030 inches (0.38-0.76 mm) or less. In addition the inserts may also have overlapping features, such as tips, ledges or shoulders as will be described further herein, to allow greater surface area to distribute the features. Such overlapping features may be used on portions of the insert for supporting an adjacent insert from internal rubber pressures, preventing extrusion between inserts, and/or adding stiffness to the seal assembly.

Figure 6A:
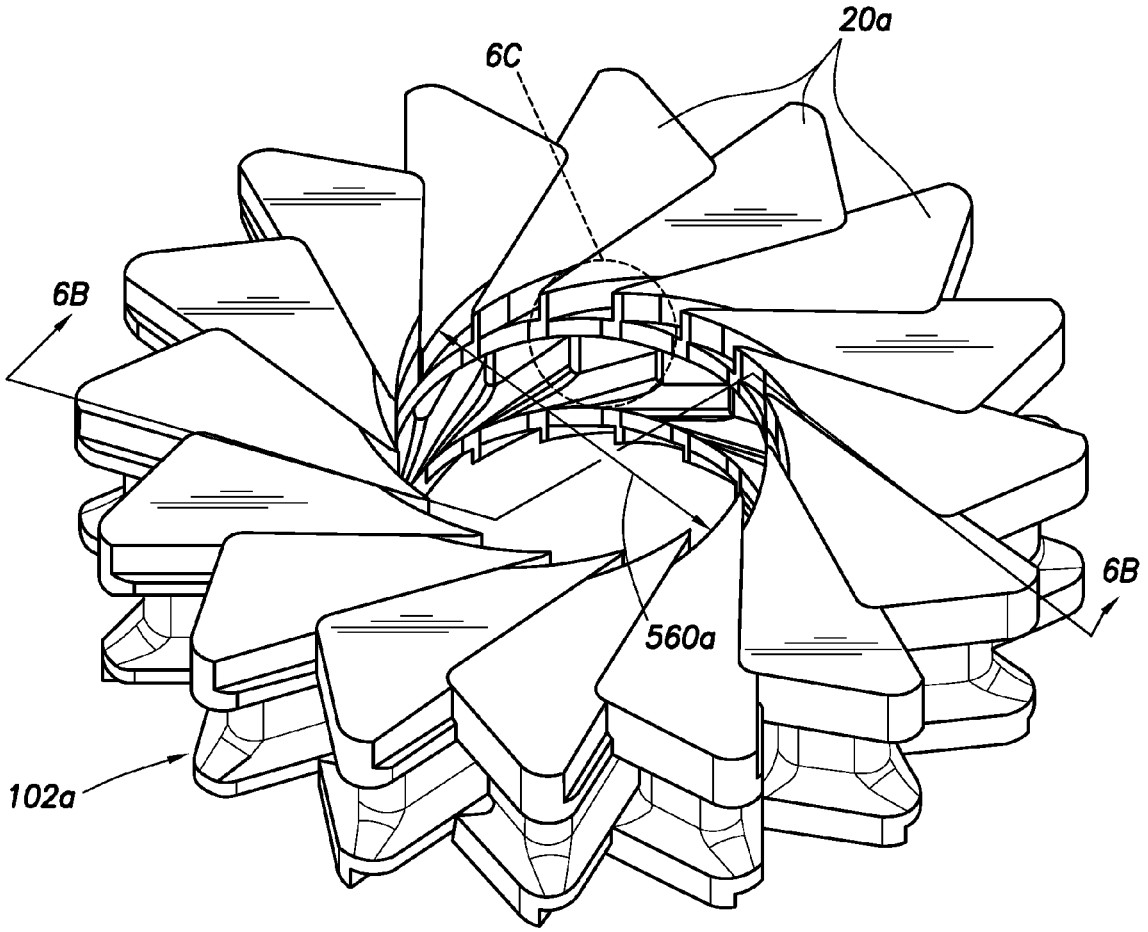
FIGS. 6A-6D are various schematic views of various portions of a seal assembly having a plurality of inserts in accordance with the disclosure.
Figure 6B:
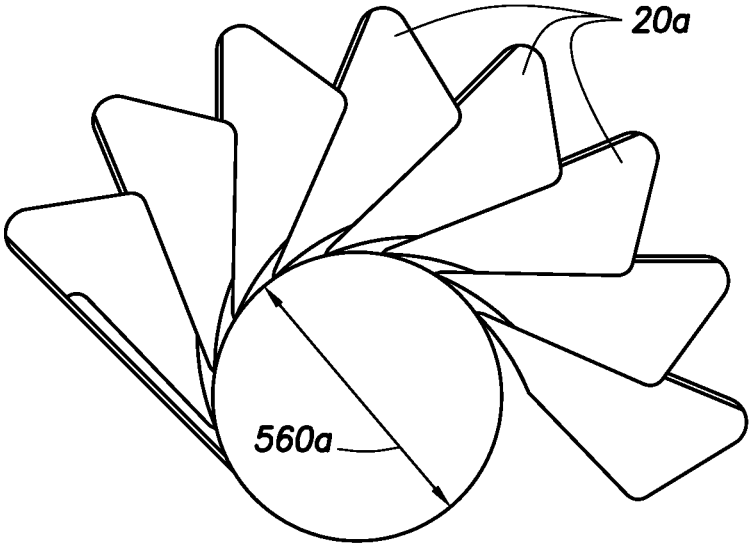
Figure 6C:
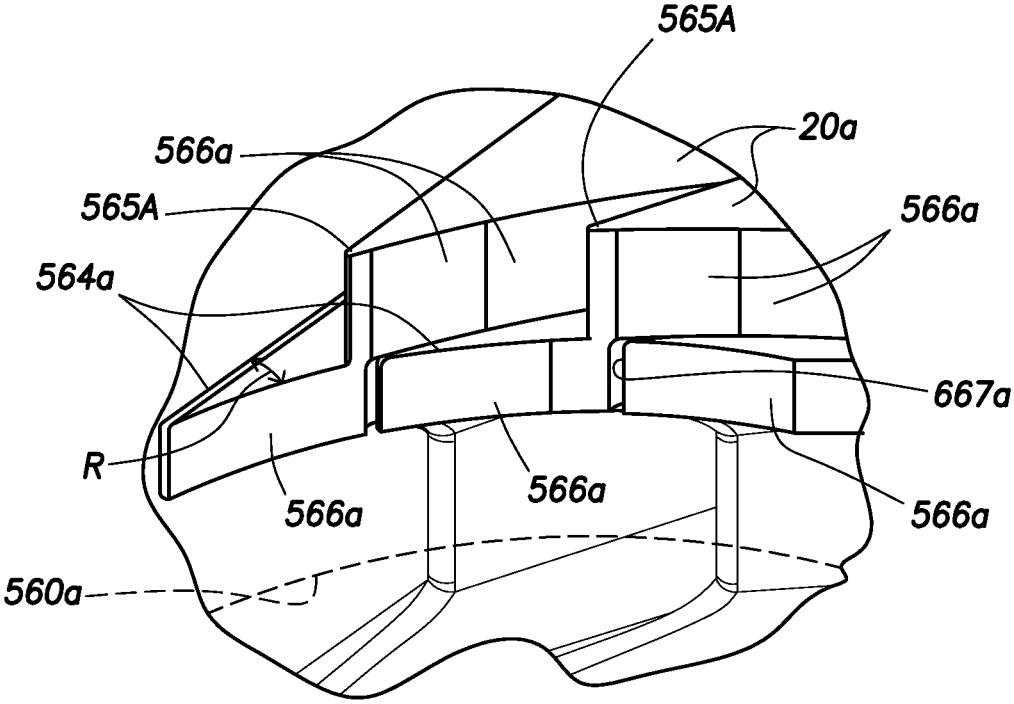
Figure 6D:
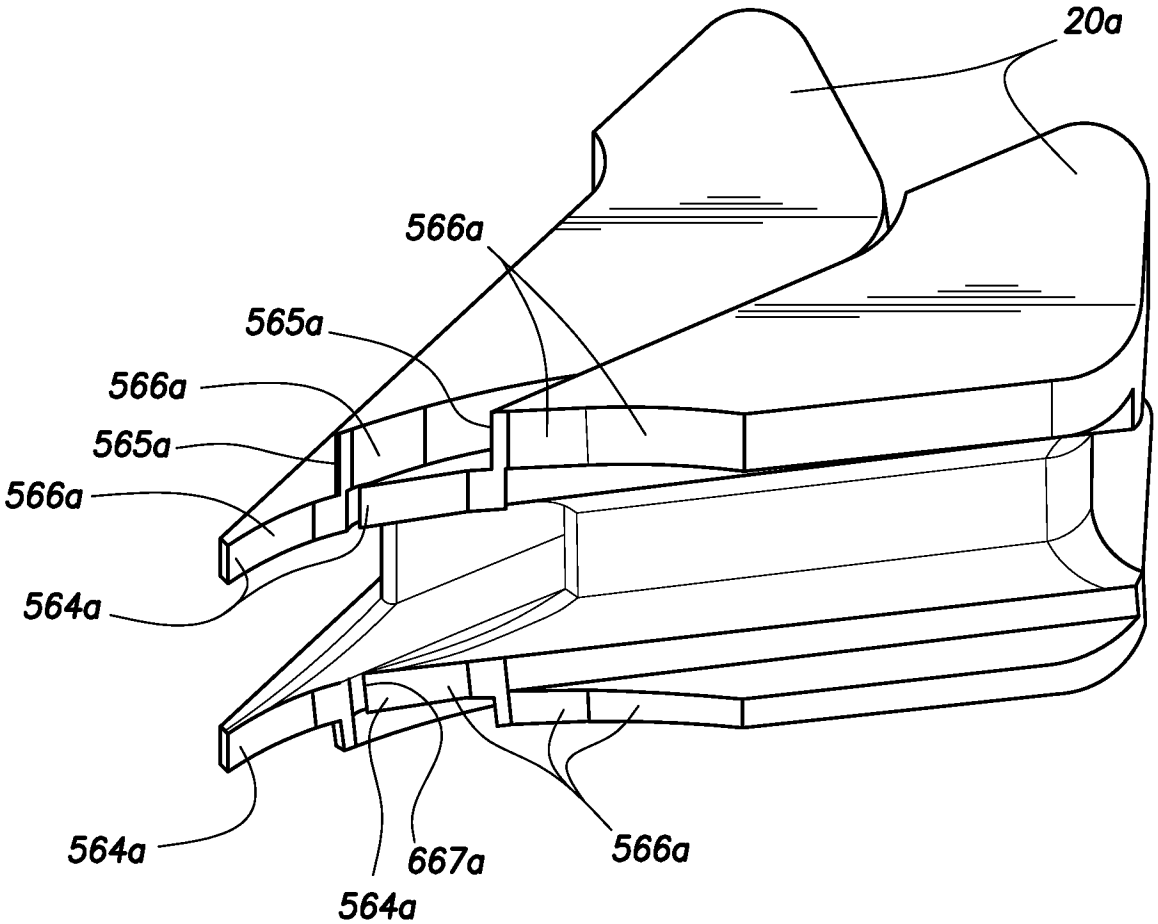

FIGS. 6A-6D show various views of an insert 20*a* usable in the seal assembly 102 of FIGS. 1-3B. FIG. 6A shows an elliptical array of the inserts 20*a* forming a portion of an alternate seal assembly 102*a* and defining a variable inner diameter 560*a*. FIG. 6B shows a portion of the array of inserts 20*a* of FIG. 6A taken along line 6B-6B. FIG. 6C is a detailed view of a portion 6C of the assembly 102*a* of FIG. 6A. FIG. 6D is a detailed view of two of the inserts 20*a* interlocked together for slidable movement therebetween.

As shown in FIGS. 6C-6D, the inserts 20*a* may be provided with extended (or pointed) tips 564*a* that terminate at a point to fill the gap 562*a* (see, e.g., FIG. 5B). The extended tip 564*a* may, for example, have a radius R of about 0.03-0.05 inches (0.76-1.27 mm) near an end thereof. A tip receptacle 667*a* may be provided in the insert 20*a* for receiving the extended tip 564*a* of an adjacent insert 20*a*, and for providing overlap between the inserts 20*a*, as will be described further herein.

The elliptical array of inserts defines an inner contact surface for engaging the pipe. The inserts 20*a* may also be provided with scallops (or contact surfaces) 566*a* for engaging the pipe 104 and further filling the gaps 562*a* about inner diameter 560*a*. One or more scallops 566*a* may be provided along the extended tip to define the contact surface for receiving the pipe 104. Multiple scallops may be provided to a curved contact surface that may conform to the shape of a variety of pipe diameters. The inserts may contract and expand about the pipe to conform to the size and shape of the pipe, and the shape of the scallops can conform to the various pipes.

FIGS. 7A-7D show the inserts 20*a* in greater detail. The inserts 20*a* cooperate with each other to radially expand and contract in an iris pattern (see, e.g., FIG. 3B, 6B). Each insert 20*a* has an upper body 768*a* and a lower body 770*a* with a rib 772*a* therebetween integrally made of metal. The upper body 768*a* has the same shape as the lower body 770*a* and is a mirror image thereof. The rib 772*a* is substantially smaller than the upper body 768*a* and lower body 770*a* to allow the rubber gland 249 to flow between the metal inserts 20*a* as the ram blocks 247 are pressed together as shown in FIG. 3B.

Figure 7A:
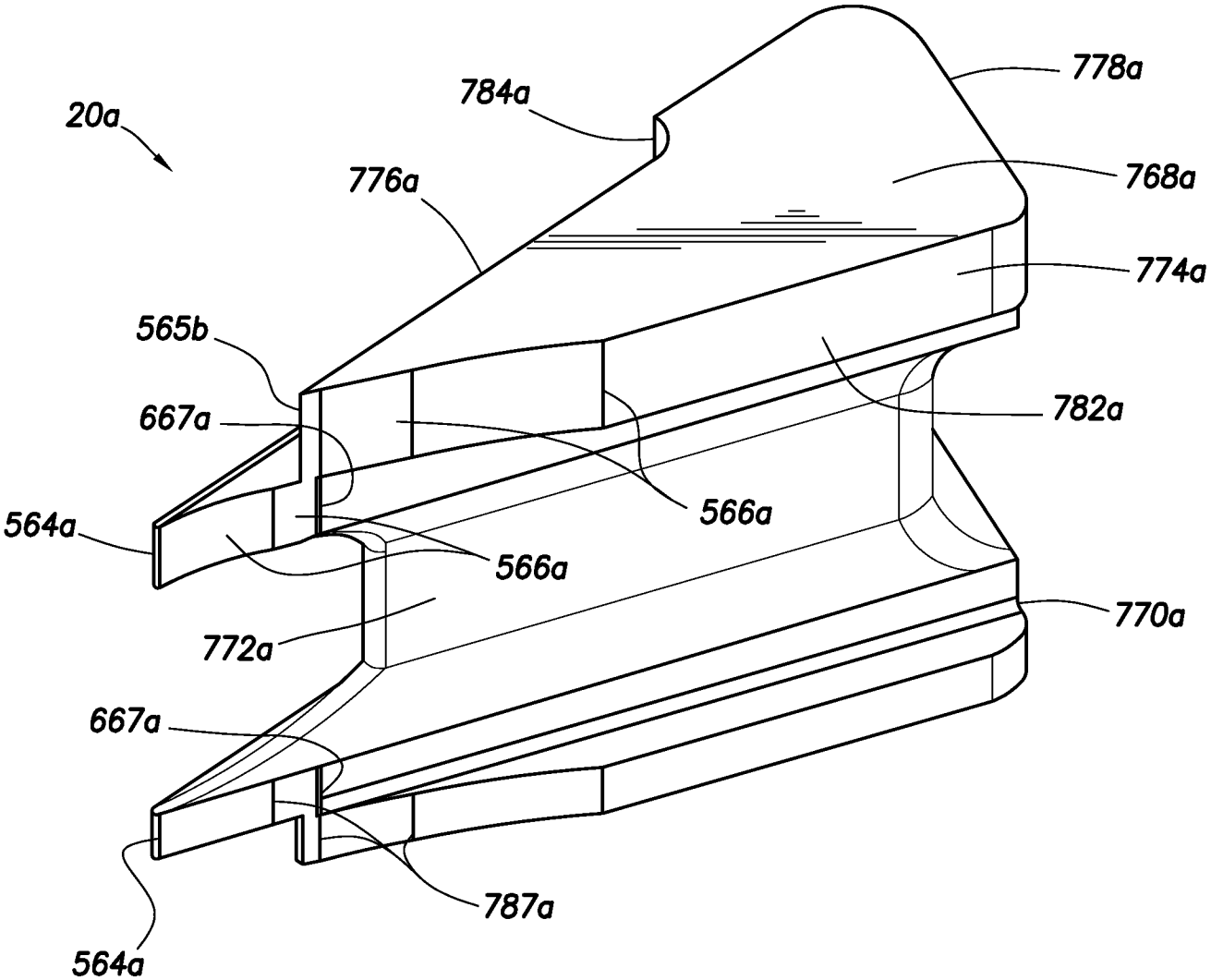
FIGS. 7A-7D are various schematic views of one of the inserts of FIG. 6A.
Figure 7C:
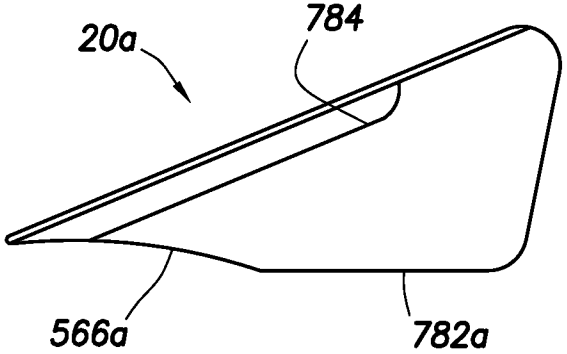
Figure 7B:
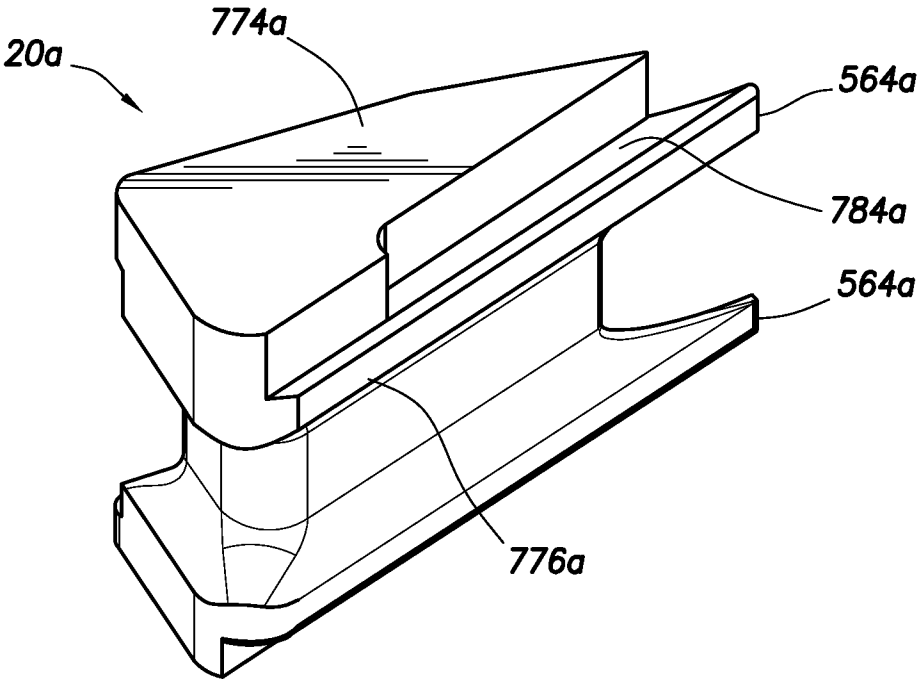

The upper body 768*a* and the lower body 770*a* each have a leading face 774*a* a shown in FIG. 7A and a trailing face 776*a* as shown in FIG. 7B. The leading face 774*a* and the trailing face 776*a* meet at the extended tip 564*a* on one end beyond secondary tip 565*a*, and are joined by a heel (or radially outwardly opposing face) 778*a* at an opposite end thereof. The upper body 768*a* and the lower body 770*a* each also have an inverted ledge 782*a* extending from the leading face 774*a*, and an inverted recess 784*a* indented into the trailing face 776*a* as shown in FIG. 7C. The inverted recess 784*a* is configured to receive the inverted ledge 782*a* of an adjacent insert as depicted in FIG. 6D for slidable support therebetween. The inverted recess 784*a* and the inverted ledge 782*a* may be mated to cooperatively interact similar to the ledge 30 and recess 36 of FIG. 4A. The ledges 782*a* and recesses 784*a* may be inverted from the configuration of ledge 30 and recess 36 positioned on an outer surface of the insert 20 of FIG. 4A. In the inverted configuration, the ledges 782*a* and recesses 784*a* are positioned on an inner surface of the upper and lower bodies 768*a*, 770*a* to further support the inserts 20*a* as pressure is applied thereto during a sealing operation.

The leading face 774*a* has a plurality of scallops (or contact surfaces or facets) 566*a* on a portion thereof as shown in FIG. 7A. One or more scallops 566*a* may be provided. As shown, four scallops 566*a* extend into the leading face 774*a*. The scallops 566*a* may be concave indentations configured to receivingly engage the pipe 104. To further reduce the gap 562*a* (FIG. 5B), the scallops 566*a* of adjacent inserts 20*a* are preferably shaped to conform to the shape of the inner diameter 560*a* (FIG. 4B). The scallops 566*a* may also be shaped such that, as the inner diameter 560*a* defined by the inserts adjusts to a given pipe size, the scallops 566*a* conform to the pipe shape. Additional scallops 566*a* may be added to provide conformity to more pipe sizes. In some cases, the scallops 566*a* may define an edge 787*a* therebetween. The edges 787*a* may optionally be flattened or curved to provide a smoother transition between the scallops 566*a*.

Figure 7D:
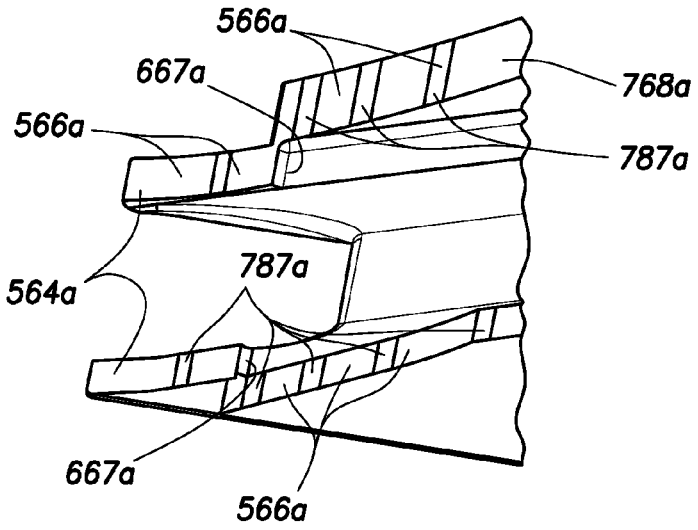
Figure 7E:
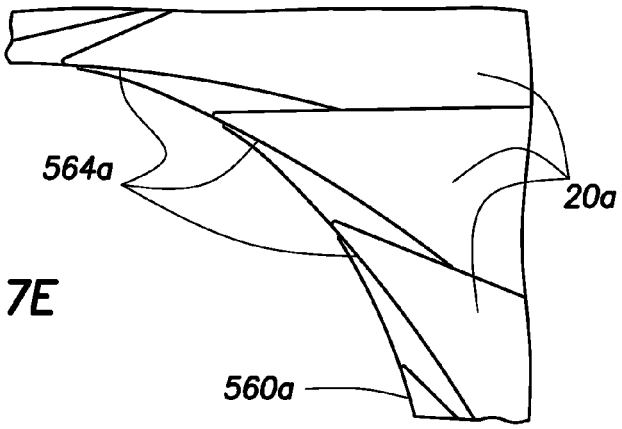
FIGS. 7E-7F are various schematic views of a portion of a seal assembly having a plurality of the inserts of FIG. 7A.
Figure 7F:
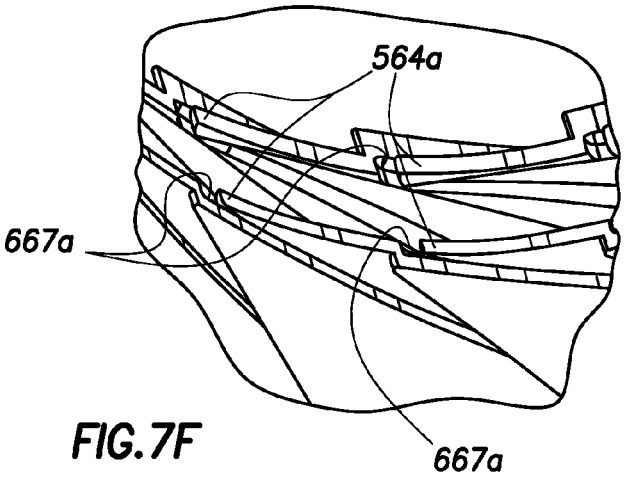

FIG. 7D shows a portion of the insert 20*a* depicting the extended tip 564*a* in greater detail. FIGS. 7E and 7F show views of a portion of an array of the inserts 20*a*. The insert 20*a* has a tip receptacle 667*a* extending into the upper body 768*a* for receiving the extended tip 564*a* of an adjacent insert 20*a*. This overlapped configuration may be used to more tightly fit the inserts 20*a* together, and further conform the extended tip 564*a* to the shape of the pipe. Additionally, this overlapping configuration may be used to further prevent extrusion between inserts.

Figure 8A:
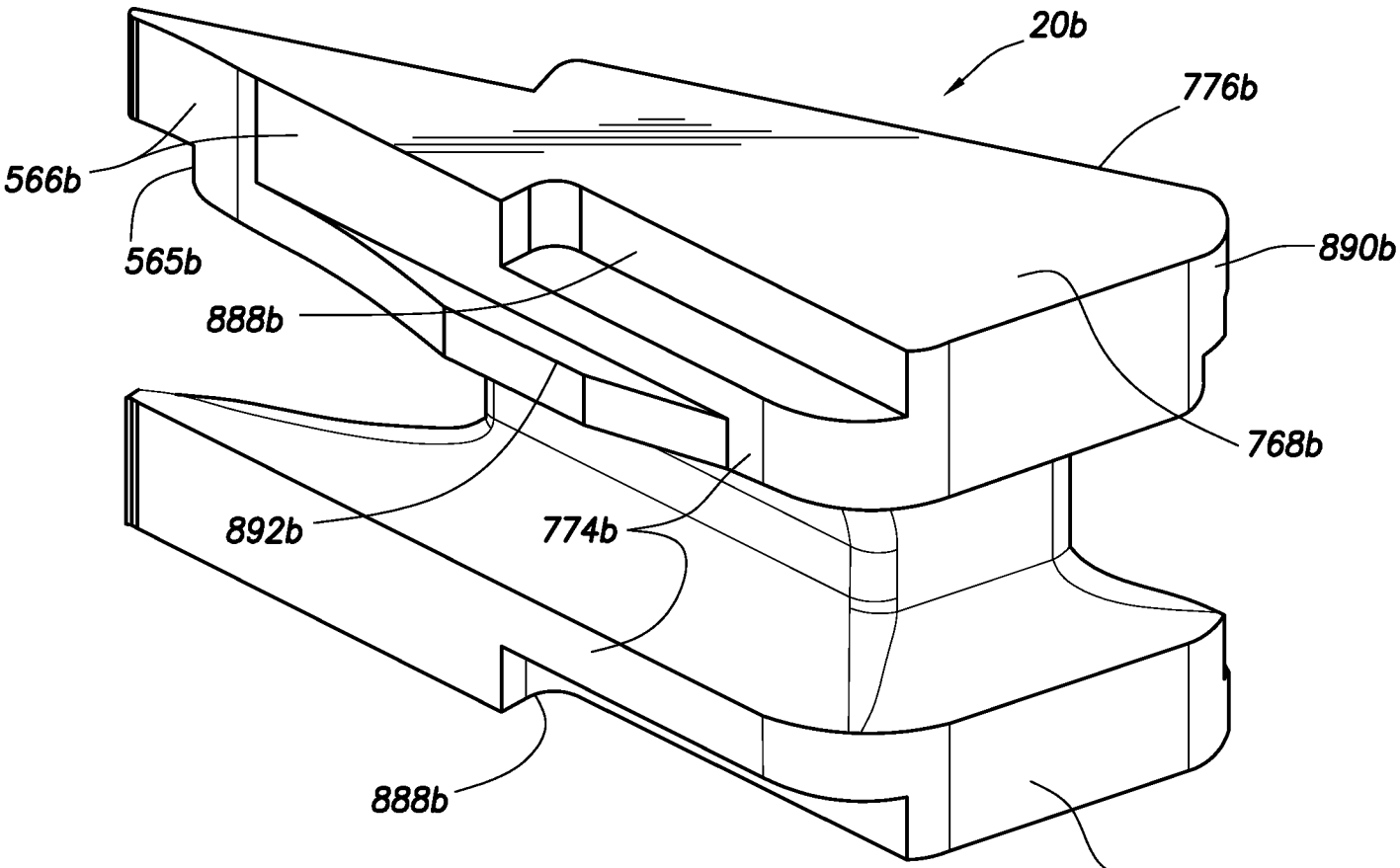
FIGS. 8A-8C are schematic views of an alternate insert.
Figure 8C:
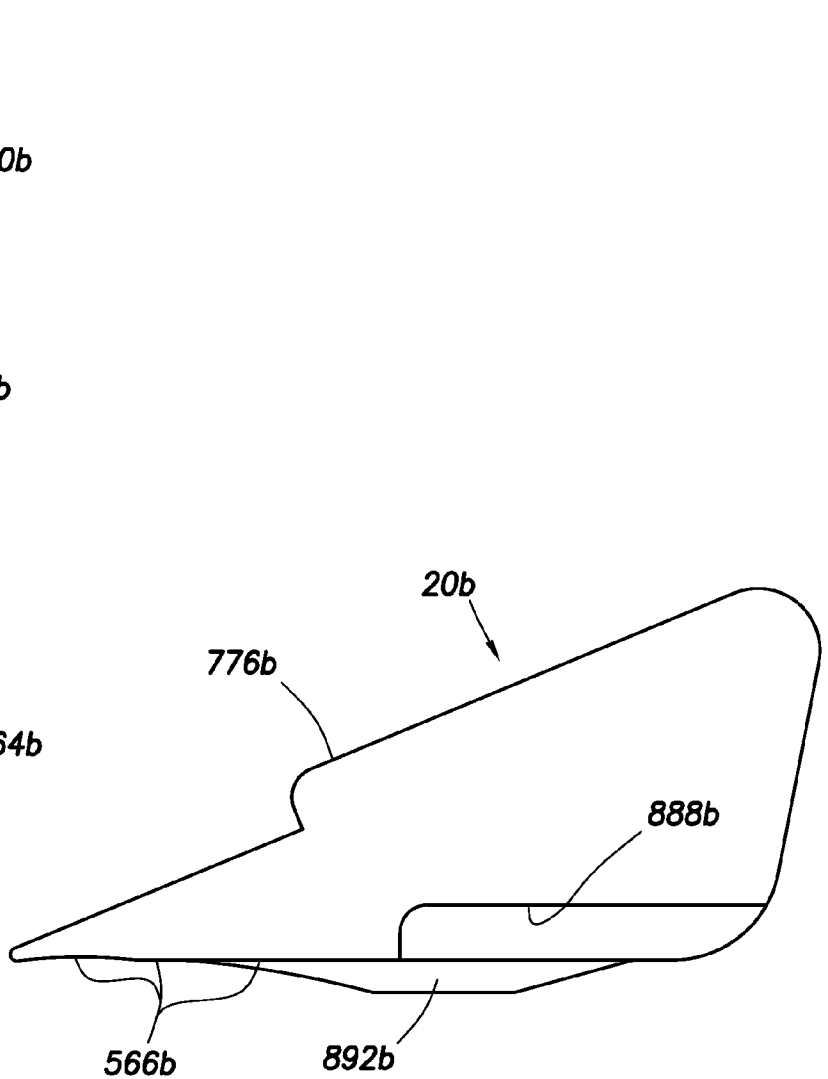
Figure 8B:
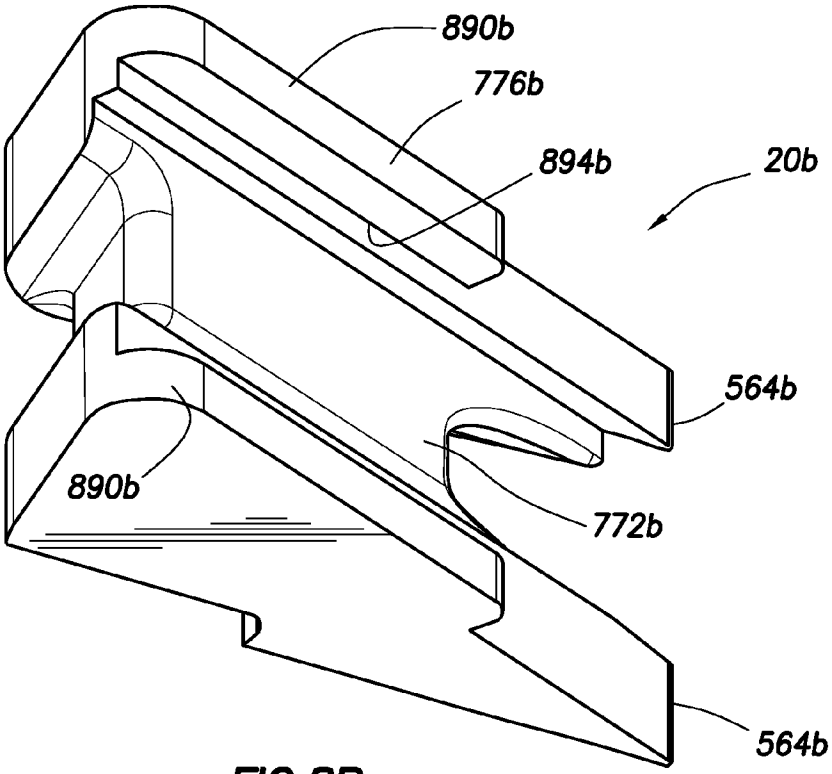

FIGS. 8A-8B show an alternate insert 20*b* that is similar to the insert 20*a*, except that the upper body 768*b* and lower body 770*b* each have a recess 888*b* extending into leading face 774*b* with corresponding ledges 890*b* extending into trailing face 776*b*. The upper body 768*b* and the lower body 770*b* have a rib 772*b* therebetween. In this configuration, the recess 888*b* and ledges 890*b* are upright (not inverted as shown in the insert 20*a* of FIGS. 7A-7F), and are positioned on an outer surface of the insert 20*b*. The recess 888*b* and ledge 890*b* may cooperatively interact similarly to the ledge 30 and recess 36 of FIG. 4A. One or more recesses 888*b* and corresponding ledges 890*b* may be provided about various portions of the upper and/or lower body 786*b*, 770*b* of each insert 20*b*.

As shown in FIGS. 8A and 8B, a shoulder (or radially inwardly directed anti-extrusion ledge) 892*b* extends from the leading face 774*b* and a corresponding ridge 894*b* extends into a trailing face 776*b* in the upper body 786*b* on each insert

20*a*. The shoulder 892*b* and ridge 894*b* may operate similar to the radially inwardly directed anti-extrusion ledge 46 of the insert 20 of FIG. 4A.

The shoulder 892*b* and ridge 894*b* define a first tier for interaction between the inserts 20*b*. The ledge 890*b* extends from the trailing face 776*b* to define a second tier for interaction with recess 888*b*. This two tier configuration may be used to support the cooperative movement and support of the inserts 20*b*, and prevent extrusion therebetween. One or more shoulders 892*b* and corresponding ridges 894*b* may also be provided about various portions of the insert 20*b* to provide support and/or prevent extrusion between adjacent inserts. Scallops 566*b* adjacent extended tip 564*b*, similar to the scallops 566*a* of FIGS. 7A-7C, may also be provided to reduce the gaps between the inserts 20*b* and further prevent extrusion therebetween. Extended tip 564*b* is provided with a secondary tip 565*b* therebelow.

Figure 9A:
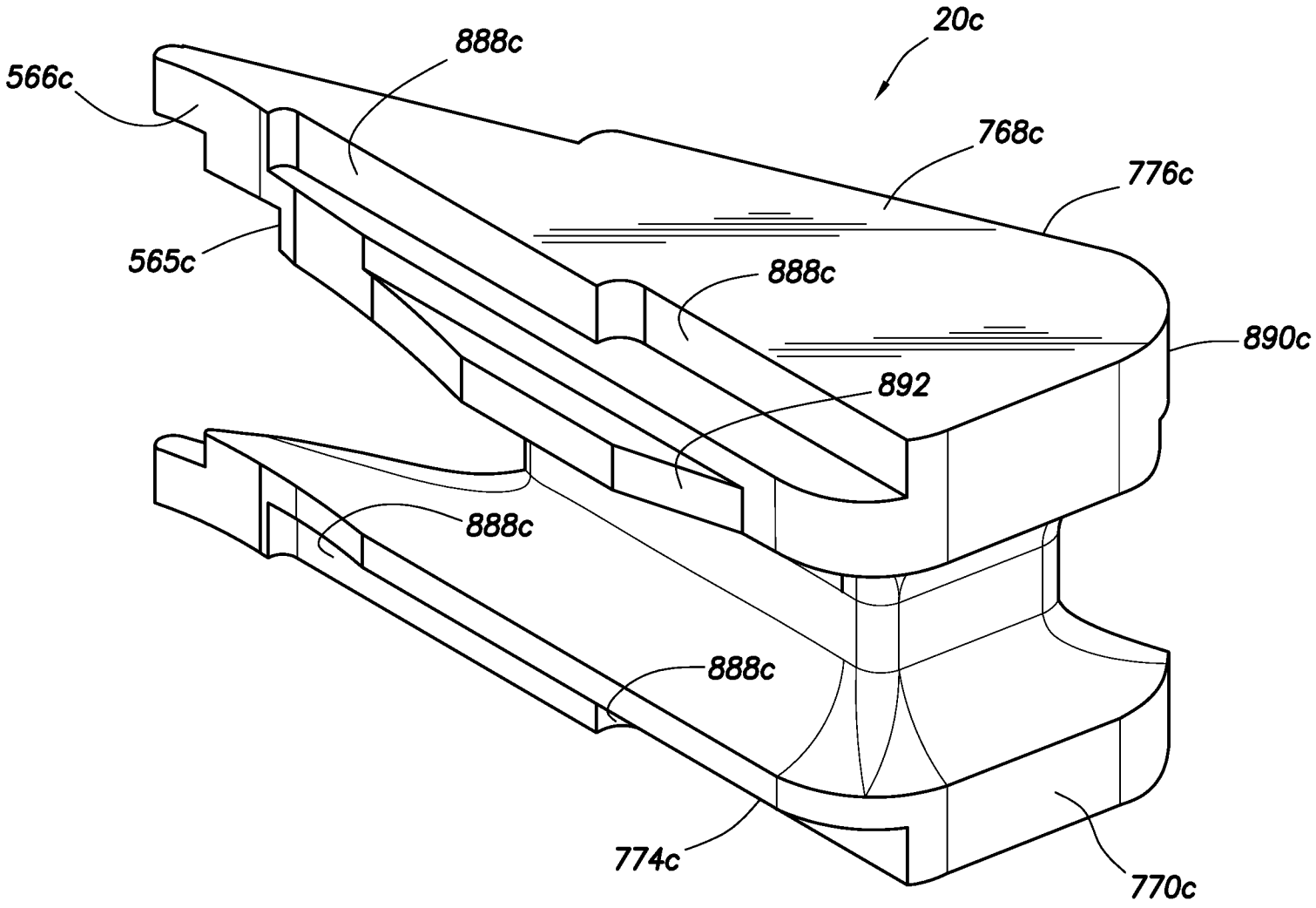
FIGS. 9A-9C are schematic views of another alternate insert.
Figure 9C:
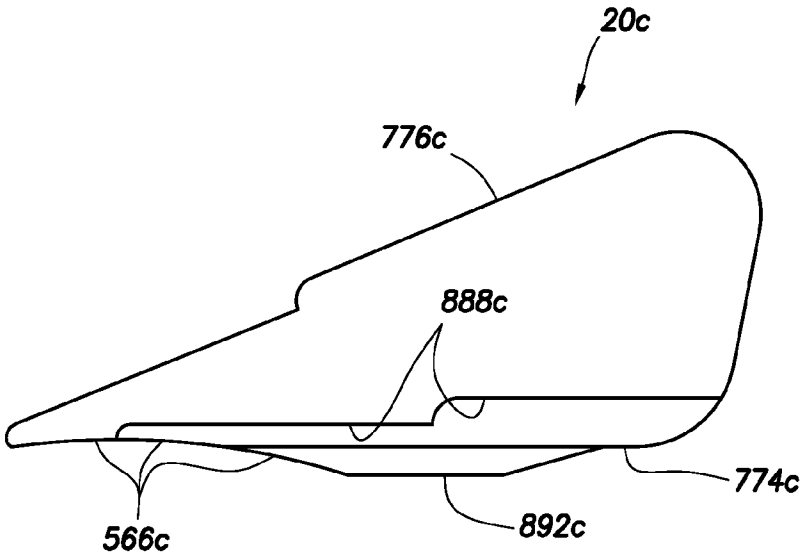
Figure 9B:
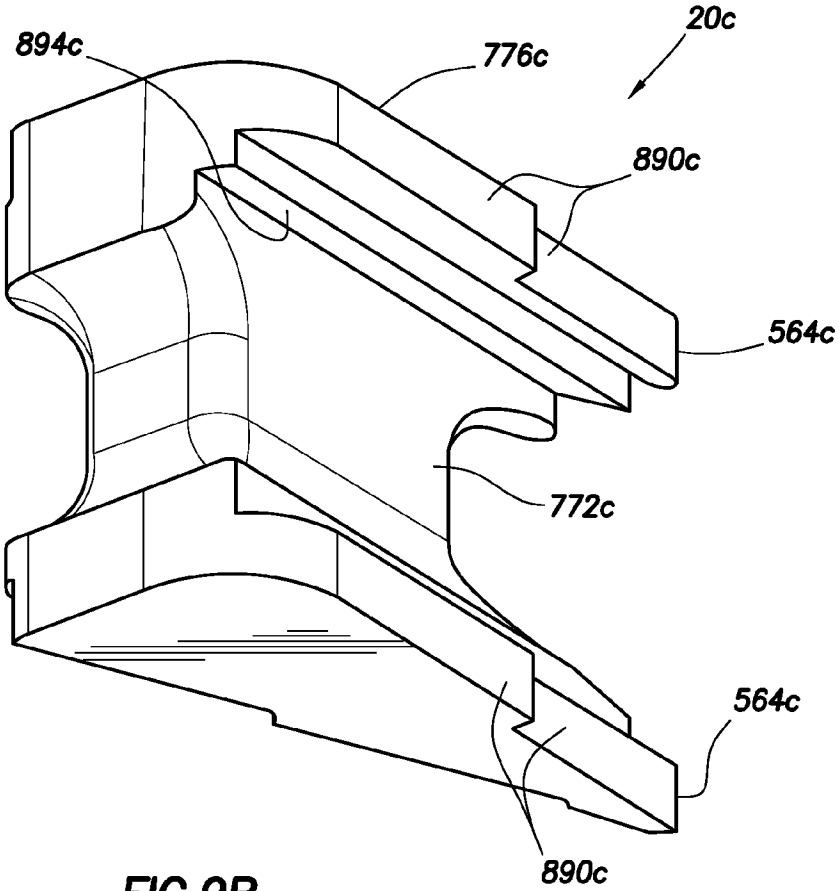

FIGS. 9A-9B show an alternate insert 20*c* that is similar to the insert 20*b*, except that the upper body 768*c* and lower body 770*c* each have multiple recesses 888*c* extending into leading face 774*c* with corresponding upright ledges 890*c* extending into trailing face 776*c*. The upper body 768*c* and the lower body 770*c* have a rib 772*c* therebetween. The multiple recesses 888*c* and multiple ledges 890*c* may cooperatively interact similarly to the ledges 890*b* and recesses 888*b* of FIGS. 8A-8B. In this case, multiple recesses 888*c* and corresponding ledges 890*c* are provided at various depths to provide for additional contact between adjacent inserts. Additional ledges 890*c* and recesses 888*c* may be used to increase the amount of overlap between inserts and/or to reduce extrusion therebetween. One or more recesses 888*c* and corresponding ledges 890*c* for receiving that shoulder may also be provided about various portions of the upper and/or lower body of each insert 20*c*.

As shown in FIGS. 9A and 9B, the insert 20*c* may also be provided with a shoulder (or radially inwardly directed anti-extrusion ledge) 892*c* extending from the leading face 774*c* and a corresponding ridge 894*c* extending into the trailing face 776*c* in the upper body 786*c* on each insert 20*c*. The shoulder 892*c* and ridge 894*c* may operate similar to the shoulder 892*b* and ridge 894*b* of FIGS. 8A and 8B.

The recesses 888*c* and shoulders 890*c* define a first and second tier for interaction between the inserts 20*c*. The shoulder 892*c* extends from the leading face 774*c* to define a third tier for interaction between the inserts 20*c*. This three tier configuration may be used to support the cooperative movement and support of the inserts 20*c*, and prevent extrusion therebetween. One or more shoulders 892*c* and corresponding ridges 894*c* may also be provided about various portions of the insert 20*c* to provide support and/or prevent extrusion between adjacent inserts. Scallops 566*c* positioned about extended tip 564*c*, similar to the scallops 566*a* of FIGS. 7A-7C, may also be provided to reduce the gaps between the inserts 20*c* and further prevent extrusion therebetween. Two extended tips 564*c* are provided with a secondary tip 565*c* therebelow.

Figure 10A:
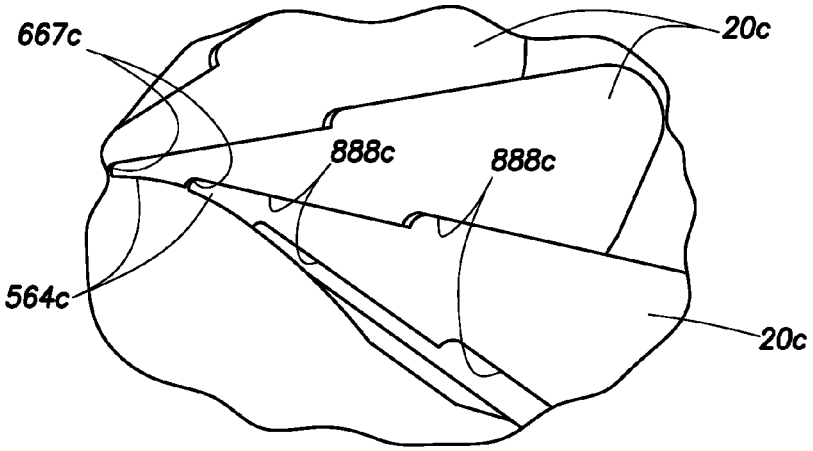
FIGS. 10A-10C are various schematic views of a portion of a seal assembly having a plurality of the inserts of FIG. 9A.
Figure 10B:
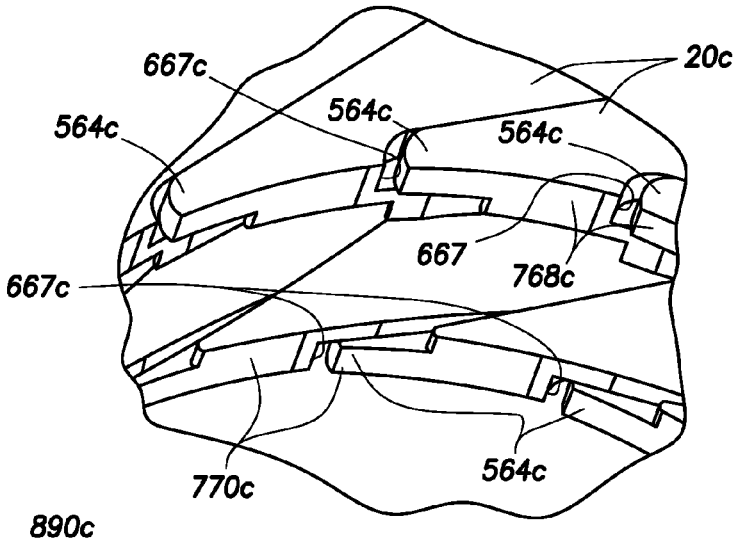
Figure 10C:
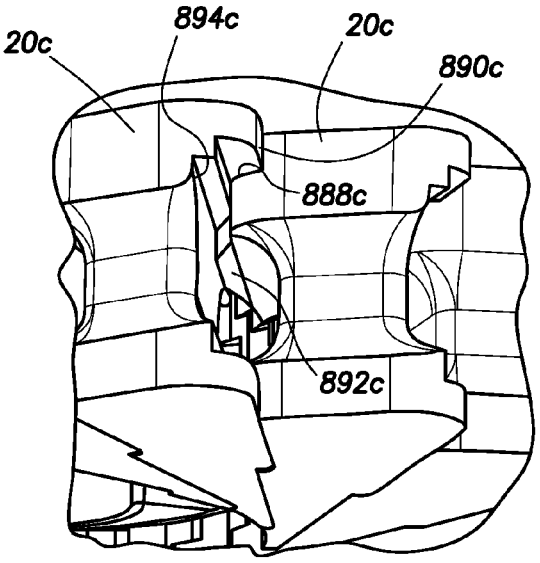

FIGS. 10A-10C show views of a portion of an array of the inserts 20*c*. Each insert 20*c* has a tip receptacle 667*c* extending into the upper body 768*c* and lower body 770*c* for receiving the extended tip 564*c* of an adjacent insert 20*c* as shown in FIGS. 10A and 10B. This overlapped configuration may be used to more tightly fit the inserts 20*c* together, and further conform the extended tips 564*c* to the shape of the pipe. FIG. 10C also shows the ledges 890*c* and shoulder 892*c* of a first insert 20*c* being received by the recesses 888*c* and ridge 894*c*, respectively of an adjacent insert 20*c* for further overlap therebetween. These overlapping configurations may also be used to further prevent extrusion between inserts.

In an example operation, the ram blocks 247 may actuated between the retracted position of FIG. 4A and to the sealed position of FIG. 4B. The inserts 20*a-c* of the seal assembly 102*a-c* may slidingly move to cooperatively conform to the shape of the pipe 104 for sealing engagement therewith. The inserts 20*a-c* may be provided with various combinations of features, such as recesses, shoulders, ridges, scallops, receptacles, and extended tips to enhance operation of the seal assembly.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the disclosure may also be configured to perform the described functions (via appropriate hardware/software) solely on site and/or remotely controlled via an extended communication (e.g., wireless, internet, satellite, etc.) network.

While the present disclosure describes specific aspects of the disclosure, numerous modifications and variations will become apparent to those skilled in the art after studying the disclosure, including use of equivalent functional and/or structural substitutes for elements described herein. For example, aspects of the disclosure can also be implemented using various combinations of one or more recesses, shoulders, ridges, scallops, receptacles, extended tips and/or other features about various portions of the inserts. All such similar variations apparent to those skilled in the art are deemed to be within the scope of the disclosure as defined by the appended claims.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the subject matter herein.

What is claimed is:

1. An insert for supporting a seal of a seal assembly of a blowout preventer, the seal assembly positionable in sealing engagement with a pipe, the insert comprising:

an upper body and a lower body with an integral rib therebetween, each of the upper and lower bodies terminating at an extended tip on a seal end thereof and having a tip receptacle on a leading face thereof;

wherein a terminal end of the extended tips is receivable in the tip receptacles of another insert whereby extrusion of the seal is restricted.

2. The insert of claim 1, wherein the upper and lower bodies each have a plurality of scallops adjacent the extended tip.

3. The insert of claim 1, wherein the upper and lower bodies each have at least one ledge and at least one recess to receive the at least one ledge of another insert.

4. The insert of claim 3, wherein the upper and lower bodies each have a plurality of ledges and a plurality of recesses.

5. The insert of claim 4, wherein the upper and lower bodies each have two ledges and two recesses.

6. The insert of claim 4, wherein the upper and lower bodies each have three ledges and three recesses.

7. The insert of claim 3, wherein the at least one ledge comprises an inverted ledge and the at least one recess comprises an inverted recess.

8. The insert of claim 3, wherein the at least one ledge comprises an upright ledge and the at least one recess comprises an upright recess.

9. The insert of claim 3, wherein the at least one ledge comprises an anti-extrusion ledge and the at least one recess comprises an anti-extrusion recess.

10. The insert of claim 1, wherein the extended tip has a radius between 0.76-1.27 mm.

11. The insert of claim 1, wherein the upper body further comprises a secondary tip a distance from the seal end.

12. A seal assembly of a blowout preventer, the blowout preventer comprising a pair of opposing ram blocks positionable about a pipe of a wellsite, the seal assembly comprising:

a pair of seals carried by the pair of opposing ram blocks; and a plurality of inserts carried by the pair of seals and positionable about the pipe in an elliptical array, each of the plurality of inserts having an upper body and a lower body with an integral rib therebetween, each of the upper and lower bodies terminating at an extended tip on a seal end thereof and having a tip receptacle on a leading face thereof;

wherein a terminal end of the extended tips is receivable in the tip receptacles of an adjacent one of the plurality of inserts whereby extrusion of the pair of seals between the plurality of inserts is restricted.

13. The seal assembly of claim 12, wherein the elliptical array of the plurality of inserts defines an inner diameter to receive the pipe.

14. The seal assembly of claim 13, wherein the inner diameter is variable.

15. The seal assembly of claim 12, wherein the plurality of inserts slidably engage each other.

16. The seal assembly of claim 12, wherein each of the plurality of inserts have mated ledges and recesses for sliding engagement therebetween.

17. The seal assembly of claim 12, wherein the plurality of inserts are interlocked together.

18. The seal assembly of claim 12, wherein the plurality of inserts is movable in an iris pattern between a contracted and expanded position.

19. The seal assembly of claim 12, wherein the plurality of inserts define a contact surface along an inner periphery of the elliptical array to contact the pipe.

20. The seal assembly of claim 19, wherein, when the plurality of inserts are positioned in sealing engagement with the pipe, an extrusion gap is defined between the plurality of inserts and the pipe.

21. The seal assembly of claim 19, wherein each of the plurality of inserts has at least one scallop about the extended tip such that, when positioned in the elliptical array about the pipe, the at least one scallop of the extended tips of the plurality of inserts defines an inner surface to receivingly engage the pipe.

22. The seal assembly of claim 19, wherein each of the plurality of inserts has a plurality of scallops about the extended tip such that, when positioned in the elliptical array about the pipe of a given diameter, the plurality of scallops of the extended tips of the plurality of inserts adjustably defines an inner surface to receivingly engage the pipe.

23. A blowout preventer for sealing a pipe of a wellsite, the blowout preventer comprising:

a housing;

a pair of opposing ram blocks positionable about a pipe of a wellsite;

a seal assembly, comprising:

a pair of seals carried by the pair of opposing ram blocks and positionable in sealing engagement about the pipe; and a plurality of inserts carried by the pair of seals and positionable about the pipe in an elliptical array, each of the plurality of inserts having an upper body and a lower body with an integral rib therebetween, each of the upper and lower bodies terminating at an extended tip on a seal end thereof and having a tip receptacle on a leading face thereof;

wherein a terminal end of the extended tips is receivable in the tip receptacles of an adjacent one of the plurality of inserts whereby extrusion of the pair of seals between the plurality of inserts is restricted.

24. The blowout preventer of claim 23, wherein the seal assemblies are movable by the ram blocks between an unsealed position away from the pipe and a sealed position in engagement with the pipe.

25. The blowout preventer of claim 20, wherein, in the sealed position, the seal assemblies encircle the pipe.

26. A method of sealing a pipe of a wellsite, the method comprising:

providing a blowout preventer comprising a housing, a pair of opposing ram blocks positionable about the pipe, and a seal assembly, the seal assembly comprising:

a pair of seals carried by the pair of opposing ram blocks; and a plurality of inserts carried by the pair of seals, each of the plurality of inserts having an upper body and a lower body with an integral rib therebetween, each of the upper and lower bodies terminating at an extended tip on a seal end thereof and a tip receptacle on a leading face thereof;

positioning the plurality of inserts of the seal assembly about the pipe in an elliptical array by advancing the opposing ram blocks toward the pipe; and restricting extrusion of the pair of seals between the plurality of inserts by receiving a terminal end of the extended tips of the upper and lower bodies of each of the plurality of inserts in the tip receptacles of an adjacent one of the plurality of inserts.

27. The method of claim 26, further comprising moving the plurality of inserts between a retracted and extended position about the pipe.

28. The method of claim 26, further comprising interlocking the plurality of inserts for sliding engagement therebetween.

29. The method of claim 26, further comprising adjustably receiving pipes of various diameters.

* * * * *